US006815603B2

(12) United States Patent
Kato et al.

(10) Patent No.: US 6,815,603 B2
(45) Date of Patent: Nov. 9, 2004

(54) UNBREAKABLE AND ECONOMICAL OPTICAL SENSOR ARRAY AND KEYBOARD MUSICAL INSTRUMENT USING THE SAME

(75) Inventors: Tadaharu Kato, Hamamatsu (JP); Shigeru Muramatsu, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 108 days.

(21) Appl. No.: 10/170,532

(22) Filed: Jun. 13, 2002

(65) Prior Publication Data

US 2002/0194986 A1 Dec. 26, 2002

(30) Foreign Application Priority Data

Jun. 26, 2001 (JP) ..... 2001-193614

(51) Int. Cl.[7] ..... G10H 1/32; G10H 3/00

(52) U.S. Cl. ..... 84/744; 84/423 R; 84/439; 84/719; 84/720; 84/745

(58) Field of Search ..... 84/16–21, 65–67, 84/423 R, 439–440, 461–462, 600–602, 615–616, 653–654, 718–720, 743–745, DIG. 7

(56) References Cited

U.S. PATENT DOCUMENTS 4,736,662 A * 4/1988 Yamamoto ..... 84/724
5,909,028 A * 6/1999 Yamamoto ..... 250/221
6,297,437 B1 * 10/2001 Ura et al. ..... 84/423 R
6,407,321 B2 * 6/2002 Tamaki et al. ..... 84/20
6,515,213 B2 * 2/2003 Muramatsu et al. ..... 84/687

OTHER PUBLICATIONS

U.S. patent application No. 09/998,522 filed Nov. 29, 2001.

* cited by examiner

*Primary Examiner*—Marlon T. Fletcher
(74) *Attorney, Agent, or Firm*—Morrison & Foerster LLP

(57) ABSTRACT

An optical sensor array includes plural sensor heads arranged on a supporting plate at intervals for monitoring moving objects such as black/white keys of a composite keyboard musical instrument; the sensor head has resiliently deformable arms on both side portions thereof and a locating hole/guide groove are formed in the reverse surface portion of the sensor head, and an expander, a grip and projections are formed in the supporting plate; when a worker slides the sensor head on the expander, the resiliently deformable arms make the gap wider so that the grip is pinched between the resiliently deformable arms and that the projections are engaged with the locating hole and guide groove, whereby the sensor head is easily fixed to and located at a predetermined position on the supporting plate.

24 Claims, 15 Drawing Sheets

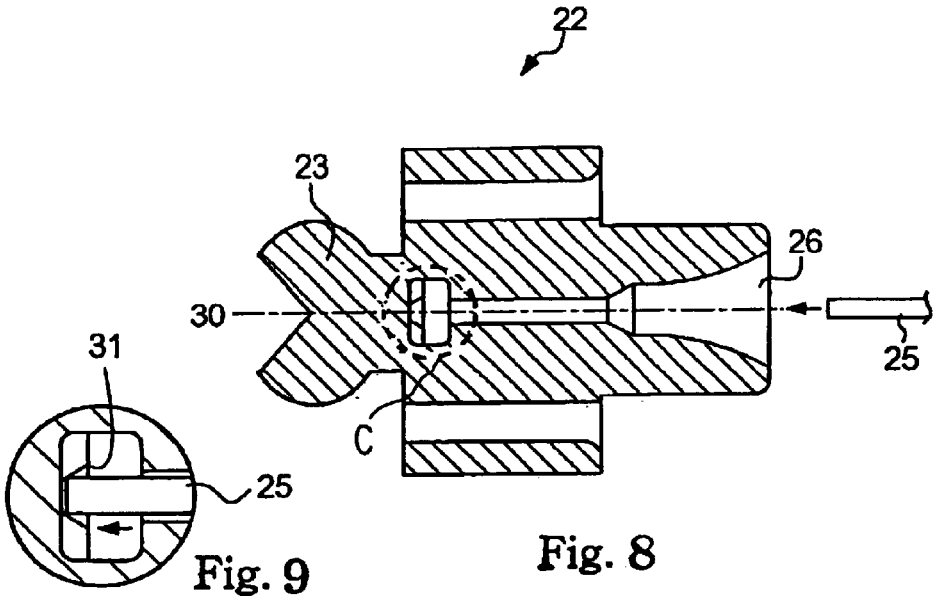
Fig. 9
Fig. 8
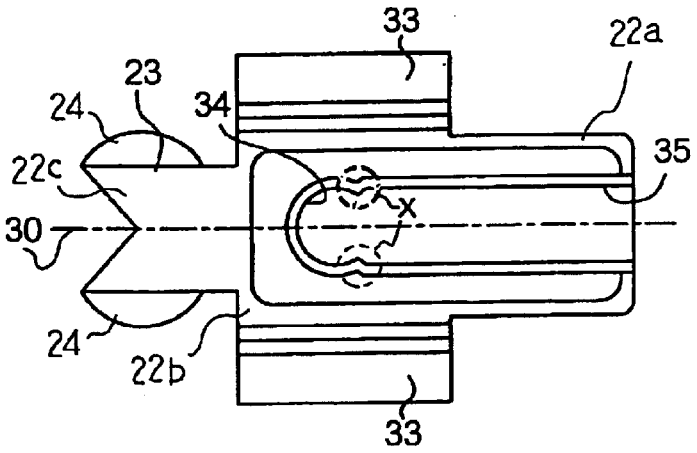
Fig. 11

UNBREAKABLE AND ECONOMICAL OPTICAL SENSOR ARRAY AND KEYBOARD MUSICAL INSTRUMENT USING THE SAME

FIELD OF THE INVENTION

This invention relates to an optical sensor array and, more particularly, to an optical sensor array for detecting current positions of plural moving objects such as, for example, keys and hammers incorporated in a keyboard musical instrument and a keyboard musical instrument using the same.

DESCRIPTION OF THE RELATED ART

Several sorts of composite keyboard musical instruments are sold in the market. A composite keyboard musical instrument is a compromise between an acoustic keyboard musical instrument, i.e., a piano and an electronic keyboard. A player can selectively play a tune through acoustic sound and electronic sound. This sort of composite keyboard musical instrument has been known as "silent piano". When a pianist instructs the silent piano to enter the acoustic sound mode, a hammer stopper is moved out of the trajectories of hammers so as to permit the hammers selectively to strike the strings for generating the piano tones. On the other hand, if the pianist wishes to practice the fingering on the keyboard, he or she changes the silent piano to the silent mode. Then, the hammer stopper is moved into the trajectories of the hammers. While the pianist is fingering a tune on the keyboard, the action mechanism selectively drives the hammers for rotation. Although the hammers escape from the action mechanism, they rebound on the hammer stopper before striking the strings. No string vibrates. Thus, the pianist can practice the fingering without disturbance to his or her neighbors.

The silent piano is equipped with an electronic sound generating system. The electronic sound generating system comprises an array of key sensors, an array of hammer sensors, a data processing unit and a headphone. The array of key sensors is provided under the array of black and white keys, and supplies key position signals representative of the current key positions of the associated black and white keys to the data processing unit. On the other hand, the array of hammer sensors is provided in the vicinity of the array of the hammers, and supplies hammer position signals representative of the current hammer positions of the associated hammers to the data processing unit. The data processing unit periodically fetches the key position signals and hammer position signals from the signal ports assigned thereto, and accumulates pieces of data information representative of the variation of key/hammer position of each key/hammer in the data storage. The data processing unit periodically checks the data storage to see whether or not the pianist depresses any one of the black/white keys for generating a tone. If the data processing unit finds the pianist to depress a black/white key, the data processing unit determines the key velocity and timing at which the piano to is to be generated. The data processing unit produces music data codes representative of the tone to be produced, and converts the music data codes to an audio signal. The audio signal is supplied to the headphone, and the pianist hears the electronically produced tone through the headphone. Thus, the key/hammer sensors are indispensable component parts of the silent piano.

FIG. 1 shows a prior art optical sensor array 100. The prior art optical sensor array serves as the key sensors, and is provided under the array of black/white keys. Reference numeral 101 designates shutter plates. The shutter plates are attached to the black/white keys, respectively, and downwardly project from the lower surfaces of the associated black/white keys.

The prior art optical sensor array 100 largely comprises a supporting plate 103, plural sensor heads 104 and pairs of optical fibers 105/111. Slits 102 are formed in the supporting plate 103 at intervals, and the shutter plates 101 are aligned with the slits 102, respectively. The slits 102 are wider than the shutter plates 101, and permit the shutter plates 101 to be moved deeply into the space under the supporting plate 103.

The plural sensor heads 104 are attached to the supporting plate 103 at intervals, and are located on both sides of the slits 102. Thus, the sensor heads 104 are arranged such that the shutter plates 101 project into and are retracted from the gaps between the sensor heads 104.

The sensor heads 104 are formed of transparent acrylic resin, and have a configuration like a combination of large and small rectangular parallelepiped blocks. The small rectangular parallelepiped block projects from an end surface of the large rectangular parallelepiped block, and shoulders take place on both sides of the small rectangular parallelepiped block. A light outlet port 108 is provided on one of the shoulders, and a light inlet port 112 is provided on the other shoulder. The light outlet port 108 and light inlet port 112 of each sensor head 104 are aligned with the light inlet port 112 of one of the adjacent sensor heads 104 and the light outlet port 108 of the other adjacent sensor head 104. Thus, the light outlet ports 108 and the light inlet ports 112 are provided on optical paths.

A prism 106 and a collimator lens 107 as a whole constitute the light outlet port 108, and a condenser lens 109 and a prism 110 form in combination the light inlet port 112. Two holes are formed in the large rectangular parallelepiped block, and are open to the shoulders and the other end surface. The optical fiber 105 is inserted into one of the holes, and reaches the prism 106. The other optical fiber 111 is also inserted into the other hole, and reaches the prism 110.

Though not shown in FIG. 1, a light emitting device (not shown) is connected to the other end of the optical fiber 105, and a light detecting device is connected to the other end of the optical fiber 111. When the light emitting device is energized, light is radiated from the light emitting device into the optical fiber 105, and optical fiber 105 propagates the light to the prism 106. The light is reflected on the oblique surface of the prism 106, and is formed into a parallel ray through the collimator lens 107. The parallel ray proceeds toward the light inlet port 112 of the adjacent sensor head 104, and is incident into the light inlet port 112 of the adjacent sensor head 104.

The incident light is reflected on the oblique surface of the prism 110, and is fallen into the optical fiber 111. The optical fiber 111 propagates the light to the light detecting device, and the light detecting device converts the light to photo current.

A pianist is assumed to depress a black/white key. The black/white key is sunk, and, accordingly, the shutter plate 101 is moved downwardly. The shutter plate 101 reaches the optical path, and gradually interrupts the parallel ray. Accordingly, the amount of incident light is reduced, and the light detecting device reduces the photo-current. Thus, the current key position is converted to the amount of photo-current.

FIG. 2 shows another prior art optical sensor array. The prior art optical sensor array comprises the supporting plate

103, sensor heads 121/122 and optical fibers 105/111. The sensor heads 121/122 are alternated with the slits 102, and each sensor head 121/122 is associated with only one optical fiber 105/111.

The sensor head 121/122 comprises a body 121*a* and a pair of lenses 107/109. The body 121*a* has side surfaces parallel to each other, and the lenses 107/109 are attached to the side surfaces. A notch forms a pair of oblique surfaces 120 in the body 121*a*, and the optical fiber 105/111 is retained by the body 121*a* in such a manner that light is radiated to and received from the pair of oblique surfaces 120.

The optical fibers 105/111 are connected to a combined optical device, i.e., the combination of light-emitting and light-detecting elements. The combined optical device sequentially supplies light to the sensor heads 121. This means that the combined optical device supplies the light to the sensor head 121 on the right side of the sensor head 122 in a time slot and to another sensor head 121 on the left side of the sensor head 122 in another time slot. Although the sensor head 122 receives the light from both sensor heads 121, the timing is different between the sensor 121 head on the right side and the sensor head 121 on the left side so that the data processing unit can determine which the light source is.

Assuming now that the combined optical device supplies the light to the sensor head 121 on the right side of the sensor head 122, the light is radiated from the optical fiber 105 toward the oblique surfaces 120, and is reflected toward both side surfaces where the lenses 107 are attached. Thus, the light beam is split into two light beams, and is radiated through the lenses 107 toward the adjacent sensor heads. One of the split light beams is incident on the lens 109, and the incident light is reflected toward the optical fiber 111. The optical fiber 111 propagates the light to the combined optical device, and the light is converted to photo-current. The photo-current is converted to a key position signal, which is supplied to the data processing unit.

When the combined optical device supplies the light to the sensor head 121 on the left side, the light is incident on the sensor head 122. The right is reflected on the oblique surfaces 120, and the reflected light is incident on the optical fiber 111. The optical fiber 111 propagates the light to the combined optical device, and the combined optical device converts the light to photo-current. The photo-current is also converted to the key position signal, which is supplied to the data processing unit. The data processing unit discriminates the key position signal on the basis of the timing and the combination of the sensor heads 121/122.

The prior art optical sensor arrays are so compact that the manufacturer can install it in a narrow space inside the composite keyboard musical instrument.

In the above-described prior art optical sensor arrays, the sensor heads 104 and 121/122 are arranged on the rear surfaces of the supporting plates 103. The light outlet ports 108/107 are to be exactly aligned with the light inlet ports 112/109 of the adjacent sensor heads 104/122. For this reason, the assembling workers are expected to pay close attention to the assemblage.

The sensor heads 104 and 121/122 are fixed to the rear surfaces of the supporting plates 103 by means of adhesive compound. However, the adhesive compound requires a time for solidification. In order to keep the relative position between the sensor heads 104 and 121/122 and the supporting plates 103, the supporting plates are formed with holes, and projections are formed in the lower surfaces of the sensor heads 104 and 121/122. The holes and projections serve as a positioner, and the manufacturer gives a tight tolerance to the positioner. When an assembling worker locates the sensor head 104 or 121/122 at a target position on the lower surface of the supporting plate 103, he or she brings the sensor head 104 or 121/122 over the hole, and strongly presses it against the supporting plate 103. Then, the projection is forced into the hole. The assembling worker injects the sensor head 104 and 121/122 with adhesive compound. After a short time, the adhesive compound is solidified, and the sensor head 104 or 121/122 is fixed to the supporting plate 103.

The first problem inherent in the prior art optical sensor arrays is that the sensor heads 104 and 121/122 are liable to be broken in the assembling work. The sensor heads 104/121/122 measure 5–10 millimeters by 5–10 millimeters, and large force is required for inserting the projection into the hole due to the tight tolerance. The sensor heads 104/121/122 are not so strong that the small sensor heads 104/121/122 can not withstand the large force.

The second problem is low productivity. The sensor heads 104/121/122 are finally fixed to the supporting plates 103 by means of the adhesive compound, and the adhesive compound requires a time for solidification. This means that the assembling worker has to stand idle until the solidification of the adhesive compound. Even though the assembling worker starts the assembling work on another one before the solidification of the adhesive compound on the previous one, the assembling worker at the next stage still waits for the solidification of the adhesive compound on the previous one. Thus, the assembling workers consume a large amount of time and labor, and the manufacturer suffers from the low productivity.

The third problem inherent in the prior art optical sensor arrays is poor repairability. When an assembling worker fixes the sensor heads 104/121/122 to the supporting plate 103, the lenses 107/109 are liable to contaminated with the adhesive compound. Even if the assembling worker is notified immediately after injecting the adhesive compound, the assembling worker feels the separation of the contaminated sensor head 104/121/122 from the supporting plate 103 hard, because the projection is tightly received in the hole. If the assembling worker is notified after the solidification of the adhesive compound, it is impossible to separate the sensor head 104/121/122 from the supporting plate 103.

Thus, the prior art optical sensor arrays are breakable and poor in productivity and repairability. Nevertheless, the optical sensor arrays are indispensable for the composite keyboard musical instruments. This means that the prior art composite keyboard musical instruments are expensive. Thus, the prior art composite keyboard musical instrument has a problem in the production cost.

SUMMARY OF THE INVENTION

It is therefore an important object of the present invention to provide an optical sensor array, which is unbreakable, high in productivity and repairability.

It is also an important object of the present invention to provide a keyboard musical instrument, the production cost of which is improved by using the optical sensor array.

To accomplish the object, the present invention proposes to connect sensor heads to and located them at target positions on retaining portions through sliding motion of the sensor heads on the retaining portions.

In accordance with one aspect of the present inventor, there is provided an optical sensor array for converting current positions of moving objects to signals comprising a supporting plate having plural retaining portions at intervals, plural sensor heads respectively assigned to the plural retaining portions and establishing optical paths for light beams across the intervals, a combined optical device optically connected to the plural sensor heads and selectively supplying light to and receiving the light from the plural sensor heads through the optical paths, plural light modifiers connected to the moving objects and moved in the optical paths for modifying the light beams depending upon the current positions of the associated moving objects, and plural locating connectors formed partially in the plural sensor heads and partially in the plural retaining portions and connecting the plural sensor heads to target positions on the retaining portions through sliding motion of the sensor heads on the associated retaining portions.

In accordance with another aspect of the present invention, there is provided a keyboard musical instrument for generating audible tones from an electric signal comprising plural tone specifying mechanisms selectively actuated by a player for specifying tones to be generated, a tone generating unit generating the tones specified by the player through the plural tone specifying mechanisms, and an optical sensor array monitoring the plural tone specifying mechanisms so as to determine the tone specifying mechanisms actuated by the player and including a supporting plate having plural retaining portions at intervals, plural sensor heads respectively assigned to the plural retaining portions and establishing optical paths for light beams across the intervals, a combined optical device optically connected to the plural sensor heads and selectively to supplying light to and receiving the light from the plural sensor heads through the optical paths, plural light modifiers connected to the plural tone specifying mechanisms and moved in the optical paths for modifying the light beams depending upon the current positions of the associated tone specifying mechanisms and plural locating connectors formed partially in the plural sensor heads and partially in the plural retaining portions and connecting the plural sensor heads to target positions on the retaining portions through sliding motion of the sensor heads on the associated retaining portions.

BRIEF DESCRIPTION OF THE DRAWINGS

The features and advantages of the optical sensor array will be more clearly understood from the following description taken in conjunction with the accompanying drawings, in which FIG. 8 is a cross sectional view taken along line B—B of FIG. 10 and showing the configuration of the guide hole, FIG. 9 is a cross sectional view showing a part of the guide hole encircled in broken line C of FIG. 8, FIG. 10 is a rear view showing resiliently deformable arms formed in the sensor head, FIG. 11 is a bottom view showing parts of a locating connector formed in the sensor head.

DESCRIPTION OF THE PREFERRED EMBODIMENT

Figure 3:
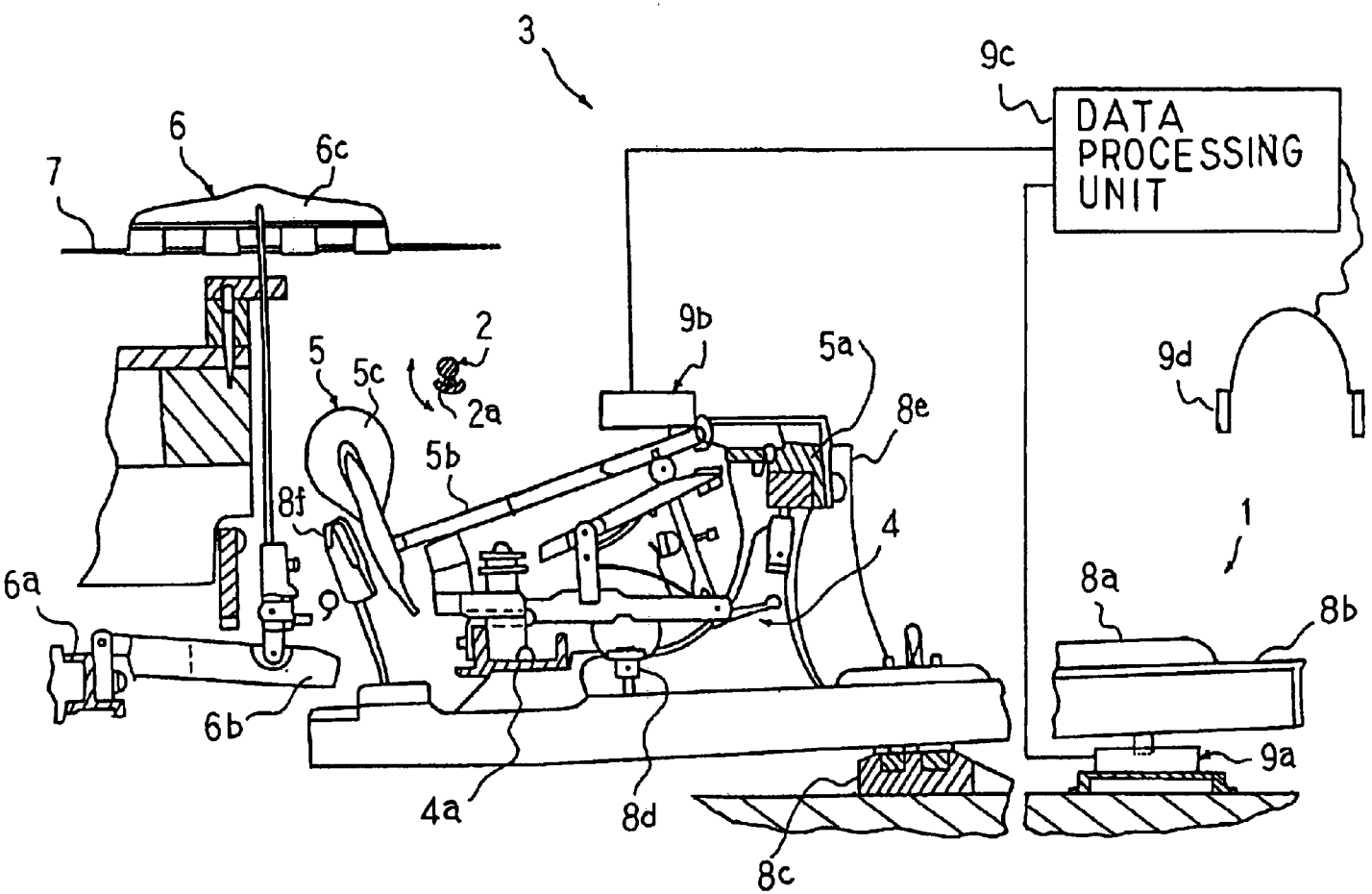
FIG. 3 is a side view showing the internal structure of a silent piano according to the present invention.

Referring to FIG. 3 of the drawings, a silent piano embodying the present invention largely comprises an acoustic piano 1, a hammer stopper 2 and an electronic sound generating system 3. In this instance, the acoustic piano 1 is a grand piano, and comprises a keyboard, action units 4, hammers 5, damper units 6 and strings 7. The keyboard is placed on a key bed, which forms a part of the piano case, and includes plural black keys 8*a* and white keys 8*b*. The black keys 8*a* and white keys 8*b* are laid on the well-known pattern, and are rotatably supported by a balance rail 8*c*. In this instance, eighty-eight black/white keys 8*a*/8*b* are incorporated in the keyboard.

A center rail 4*a* laterally extending over the rear portions of the keyboard. The action units 4 are rotatably supported by the center rail 4*a*, and are held in contact with balance pins 8*d* projecting from the associated black/white keys 8*a*/8*b*. Thus, the black/white keys 8*a*/8*b* are linked with the associated action units 4, and give rise to rotation around the center rail 4*a* when a pianist depresses the black/white keys 8*a*/8*b*.

Action brackets 8*e* are provided on the key bed at intervals, and are laterally spaced from one another. A shank flange rail 5*a* laterally extends over the keyboard, and is supported by the action brackets 8*e*. The hammers 5 have hammer shanks 5*b* and hammer heads 5*c*. The hammer heads 5*c* are connected to the hammer shanks 5*b*, respectively. The hammer shanks 5*b* are swingably connected to the hammer shank rail 5*a*, and are rest on the associated action units 4. Thus, the hammers 5 are linked with the associated shank flange rail 5*a*, and are driven for rotation by the associated action units 4.

A damper lever rail 6*a* laterally extends at the back of the keyboard, and the damper units 6 have damper levers 6*b* and damper heads 6*c*. The damper levers 6*b* are swingably supported by the damper lever rail 6*a*, and projects into the space over the rear end portions of the black/white keys 8*a*/8*b*. The damper heads 6*c* are respectively connected to the damper levers 6*b*, and are rest on the associated strings 7. The strings 7 are stretched over the array of hammers 5, and are to be struck with the associated hammers 5.

The hammer stopper 2 laterally extends over the hammers 5, and is changed between a free position and a blocking position by means of a suitable actuator such as, for example, a link mechanism or an electric motor. When the player changes the hammer stopper 2 to the blocking position, the hammer stopper 2 directs the shock absorber 2*a* toward the hammer shanks 5*b*, and the shock absorber 2*a* enters the trajectories of the hammer shanks 5*b*. On the other hand, when the pianist changes the hammer stopper 2 to the free position, the hammer stopper 2 rearward directs the shock absorber 2*a*, and the shock absorber 2*a* is evacuated from the trajectories of the hammer shanks 5*b*.

The player is assumed to depress the white key 8*b*. The front portion of the white key 8*b* is sunk toward an end position, and gives rise to the rotation of the associated action unit 4 about the center rail 4*a* in the counter clockwise direction. Accordingly, the hammer 5 is gradually rotated about the shank flange rail 8*f* in the clockwise direction. The rear end portion of the white key 8*b* is brought into contact with the damper lever 6*b*, and gives rise to rotation of the damper lever 6*b* about the damper lever rail 6*a*.

The player further exerts the force on the white key 8*b*. The rear end portion of the white key 8*b* lifts the damper head 6*c*, and makes the damper head 6*c* spaced from the associated string 7. The action unit 4 escapes from the hammer 5 on the way to the end portion. Then, the hammer 6 starts the free rotation about the shank flange rail 8*f*. The hammer is getting closer and closer to the associated string 7.

If the player keeps the hammer stopper 2 at the free position, the shock absorber 2*a* is out of the trajectories of the hammer shanks 5*b*, and the string 7 is struck with the hammer head 6*c*. The string 7 vibrates, and generates the piano tone. On the other hand, if the player has changed the hammer stopper 2 to the blocking position, the shock absorber 2*a* is in the trajectories of the hammer shanks 5*b*. The hammer shank 5*b* rebounds on the shock absorber 2*a* before the hammer head 5*c* reaches the string 7 so that any piano tone is not generated.

Upon rebounding on either string or hammer stopper, the hammer 5 returns toward the rest position. A back check 8*f*, which is upright on the rear end portion of the key, receives the hammer 5. When the player releases the white key 8*b*, the damper 6 is brought into contact with the string 7, again, and, thereafter, the white key 8*b* and the action unit 4 return to the respective rest positions.

The electronic sound generating system 3 includes an array of key sensors 9*a*, an array of hammer sensors 9*b*, a data processing unit 9*c* and a headphone 9*d*. One of or each of the sensor arrays 9*a*/9*b* is implemented by an optical sensor array 10 embodying the present invention. If the optical sensor array 10 serves as one of the sensor arrays 9*a*/9*b*, another sort of optical sensor array is available for the other of the sensor arrays 9*a*/9*b*. The array of key sensors 9*a* is connected to a signal input port of the data processing unit 9*c*, and the array of hammer sensors 9*b* is connected to another signal input port of the data processing unit 9*c*.

The array of key sensors 9*a* is provided under the black/white keys 8*a*/8*b*, and monitors the black/white keys 8*a*/8*b* for reporting current key positions to the data processing unit 9*c*. On the other hand, the array of hammer sensors 9*b* is provided in the vicinity of the hammer shanks 5*b*, and is supported by the shank flange rail 5*a*. The key sensors and hammer sensors are accommodated in suitable photo-shielded cases, and are not seen in FIG. 3.

The data processing unit 9*c* periodically fetches pieces of positional data information representative of current key positions and current hammer positions, and accumulates the pieces of current key/hammer positions in a data memory thereof. The data processing unit 9*c* checks the data memory to see whether or not any one of the keys/hammers 8*a*/8*b*/5 changes the current position after the previous data fetch. If the answer is given negative, the data processing unit 9*c* repeats the periodical data fetch and analysis. When the data processing unit 9*c* finds that the player depresses a black/white key 8*a*/8*b*, the data processing unit 9*c* specifies the depressed key, and predicts a time at which the hammer head 5 will strike the string 7. The data processing unit 9*c* waits for the hammer position signal representative of the variation of the current hammer position of the associated hammer 5. When the hammer 5 reaches a detectable range of the hammer sensor 9*b*, the hammer sensor 9*b* varies the hammer position, and the data processing unit 9*c* calculates the hammer velocity on the basis of the series of current hammer position. The data processing unit 9*c* determines the loudness of an electric tone proportionally to the hammer velocity.

The data processing unit 9*c* waits for the time at which the hammer strikes the string 7. When the time comes, the data processing unit 9*c* produces music data codes representative of the depressed key 8*a*/8*b*, note-on, loudness of electric tone and so forth, and a tone generator, which is incorporated in the data processing unit 9*c*, produces an audio signal from the music data codes. The audio signal is supplied to the headphone 9*d*, and is converted to the electronic tone.

When the player releases the depressed key 8*a*/8*b*, the black/white key 8*a*/8*b* starts to return toward the rest position. The associated key sensor notifies the data processing unit 9*c* of the backward motion. The data processing unit 9*c* produces music data codes representative of the released key 8*b* and note-off, and supplies them to the tone generator at the time when the damper head 6*c* is brought into contact with the string 7. The tone generator decays the audio signal. Then, the electronic tone is decayed.

While the player is fingering on the keyboard, the data processing unit 9*c* cooperates with the sensor arrays 9*a*/9*b*, and repeats the above-described data processing sequence for each depressed/released key. As a result, the silent piano generates electronic tones instead of the piano tones so that the player can confirm his or her fingering through the headphone 9*d*.

Figure 4:
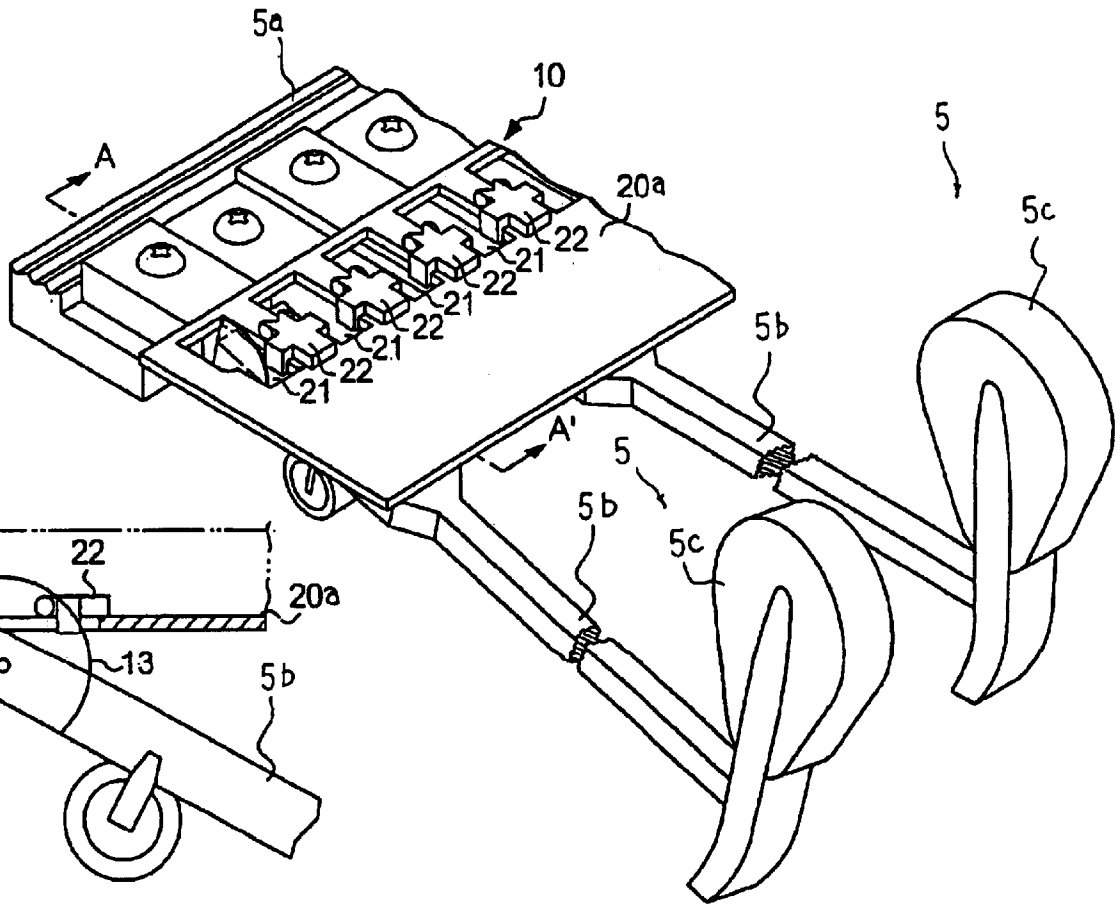
FIG. 4 is a perspective view showing the arrangement of an optical sensor array incorporated in the silent piano.
Figure 5:
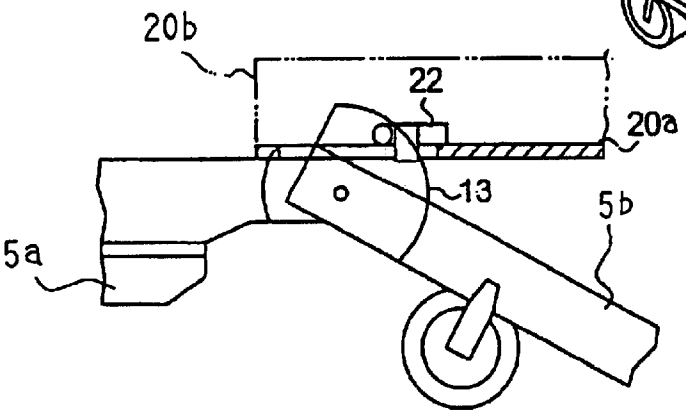
FIG. 5 is a cross sectional view taken along line A–A' and showing the relative position between a hammer and one of the optical sensors.
Figure 6:
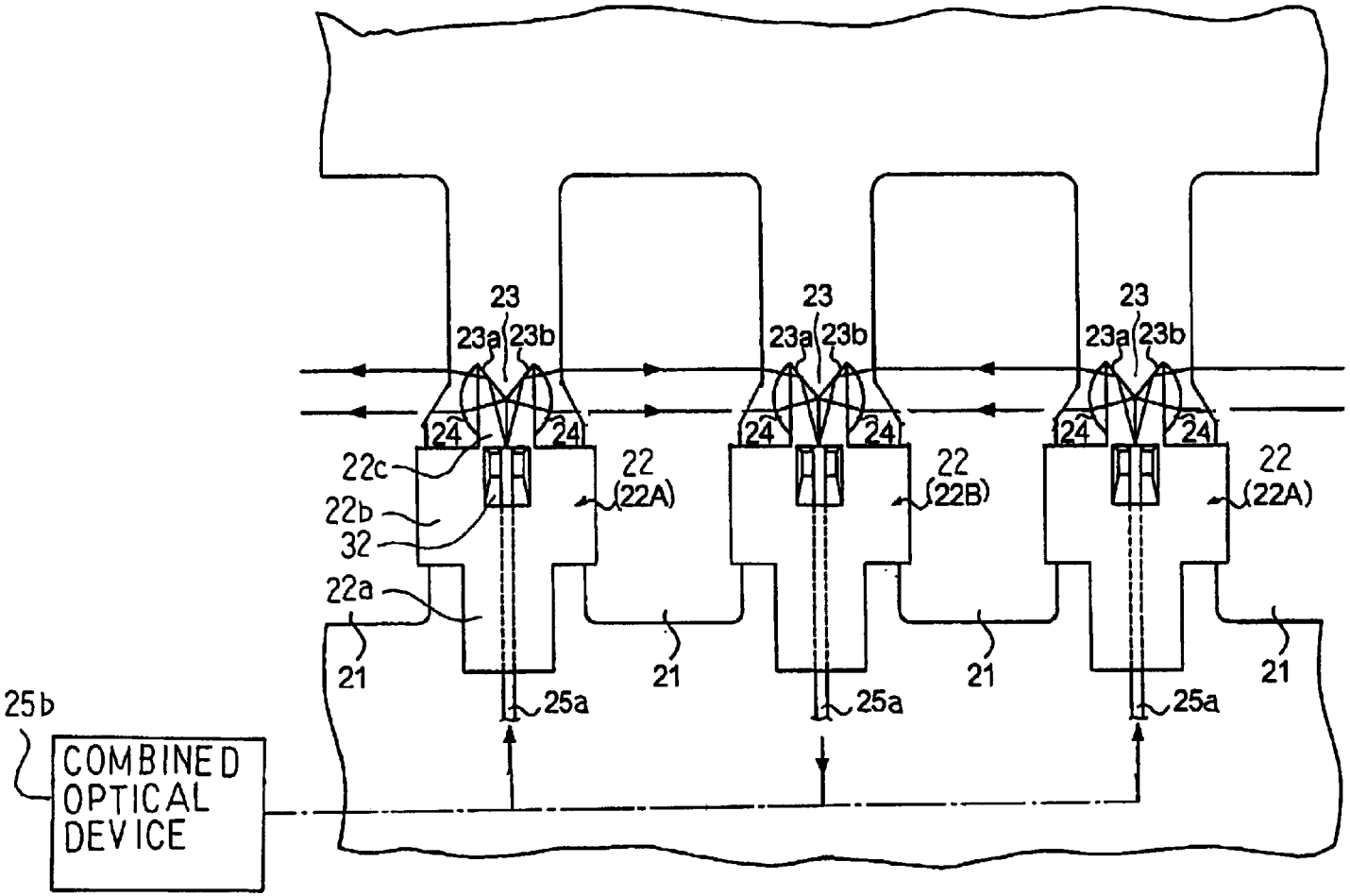
FIG. 6 is a plane view showing the arrangement of sensor heads.

Description is hereinbelow made on an optical sensor array 10 with reference to FIGS. 4, 5 and 6 of the drawings. The optical sensor array 10 is available for the array of key sensors 9*a* and/or the array of hammer sensors 9*b*. Nevertheless, the optical sensor array 10 shown in FIGS. 4 to 6 is used as the array of hammer sensors 9*b* in this instance.

The optical sensor array 10 comprises sectorial plates 13, a supporting plate 20*a*, a cover plate 20*b*, plural sensor heads 22, optical fibers 25*a* and a combined optical device 25*b*. The sectorial plates 13 are fixed to the joint end portions of the hammer shanks 5*b*, respectively, and a gray scale is printed on the sectorial plates 13. Although the gray scale is printed, the sectorial plates 13 permit light to pass therethrough.

The supporting plate 20*a* laterally extends over the hammer shanks 5*b*, and is fixed to the shank flange rail 5*a* by means of bolts. Plural slits 21 are formed in the supporting plate 20*a*, and are laterally spaced at intervals equal to the pitches of the array of hammers 5. The sectorial plates 13 are respectively assigned to the slits 21, and are partially in the slits 21. While the hammers 5 are rotating toward the associated strings 7, the sectorial plates 13 further project into the slits. Thus, the sectorial plates 13 are movable with respect to the shank flange rail 5*a*.

The sensor heads 22 are arranged on the supporting plate 20*a* at the intervals, and are alternated with the slits 21. The sensor heads 22 are fixed to the supporting plate 20*a*, and are stationary with respect to the shank flange rail 5*a*. Plural light emitting elements and plural light-detecting elements constitute the combined optical device 25*b*. The combined optical device 25*b* is connected through the optical fibers 25*a* to the sensor heads 22 so that light is radiated from selected ones 22A of the sensor heads 22 through the associated sectorial plates 13 to the adjacent sensor heads 22B. The sensor heads 22A and 22B form plural combinations equal to the hammers 5. While the hammer 5 is rotating, the associated plate 13 gradually changes the relative position between the gray scale and the associated sensor head, and the current hammer position is converted to the amount of light incident onto the adjacent sensor heads 22.

The supporting plate 20*a* is assembled with the cover plate 20*b* so as to form the photo-shielded case. The sensor heads 22 are photo-shielded by virtue of the photo-shielded case, and is less influenced with the environmental light. The component parts of the optical sensor array 10 are hereinbelow described in detail.

Sensor Head

The sensor heads 22 are formed of transparent synthetic resin such as, for example, acrylic resin. The synthetic resin has a value of refractive index equal to or close to that of the optical fiber. The sensor heads 22 is monolithic, and has a cross-like configuration. The sensor head 22 is divided into three portions, which are hereinbelow referred to as a narrow portion 22*a*, a wide portion 22*b* and a head portion 22*c*.

Figure 7:
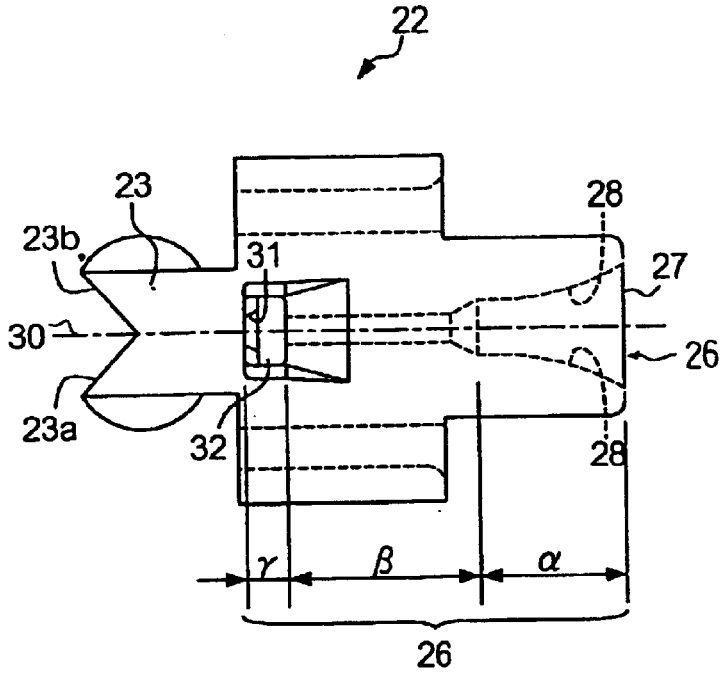
FIG. 7 is a plane view showing the sensor head in detail.
Figure 1:
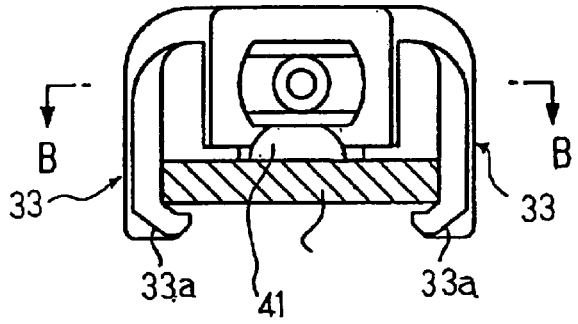

A notch 23 is formed in the head portion 22*c* so that the head portion 22*c* has a pair of ports 23*a*/23*b*. The two ports 23*a*/23*b* have respective side surfaces substantially parallel to each other and respective oblique surfaces inclined to the associated side surfaces at 45 degrees. The sensor head 22 has a symmetrical line 30 (see FIG. 7), and the oblique surfaces are crossed on the symmetrical line 30. Two oblique surfaces define the notch 23, and are spaced at 90 degrees. Lenses 24 are fixed to the side surfaces. The lenses 24 serve as collimator lenses in the sensor head 22*a* and as condenser lenses in the sensor head 22B.

The central portion 22*b* is formed with a rectangular pit 32 adjacent to the head portion 22*c*, and a coupling recess 31 (see FIG. 7) is formed on the inner wall partially defining the pit 32. A guide hole 26 is formed in the narrow/wide portions 22*a*/22*b*, and extends along the symmetrical line. The guide hole 26 has an entrance 27 at the rear end surface of the narrow portion 21*a*, and is open to the pit 32 at the other end thereof (see FIG. 8). The optical fiber 25*a* is inserted from the entrance 27. The optical fiber 25*a* passes through the guide hole 26, and enters into the rectangular pit 32.

The guide hole 26 has an inverted bell portion α, and a straight portion β, and the pit 32 serves as a correcting portion γ. The centerlines of the inverted bell/straight portions α/β are substantially coincident with the symmetrical line 30. The inverted bell portion α is defined by a curved surface 28 so that the inverted bell portion α has the cross section gradually reduced from the entrance 27 toward the straight portion β. The entrance 27 is wide enough to receive the optical fiber 25*a*. An assembling worker can easily insert the optical fiber 25*a* through the entrance 27 into the inverted bell portion α. After the insertion, the assembling worker pushes the optical fiber 25*a* into the inverted bell portion α. Then, the curved surface 28 guides the optical fiber 25*a* to the straight portion β. The inverted bell portion α is long so that the optical fiber 25*a* smoothly reaches the boundary between the inverted bell portion α and the straight portion β without bending. In detail, the long inverted bell portion α is permitted to have the gently curved surface 28, and the cross section is surely reduced in the vicinity of the boundary. Even if the leading end of the optical fiber 25*a* is caught on the curved surface 28 near the boundary, the reduced cross section does not permit the optical fiber widely to be warped in the inverted bell portion. If the inverted bell portion α is too short, the cross section is to be rapidly reduced near the boundary. This means that the cross section is still wide near the boundary. If the leading end of the optical fiber 25*a* is caught on the curved surface 28 near the boundary, the optical fiber 25*a* is widely warped in the inverted bell portion α, and the optical fiber 25*a* does not proceed to the straight portion β. Thus, the long inverted bell portion α prevents the optical fiber 25*a* from the warp, and keeps the optical fiber straight in the sensor head 22. If the optical fiber remains seriously warped in the guide hole 26, the optical fiber exhibits optical characteristics out of the design specification, and makes the data processing unit mistakenly determine the current hammer position. The present inventors investigated the minimum radius of curvature to be allowed. The present inventors found that the minimum radius of curvature was 5 millimeters. Even if the optical fibers 25*a* were warped to have the radius of curvature equal to or greater than 5 millimeters, the optical fibers 25*a* could exactly relay the pieces of positional information to the data processing unit. However, if the radius of curvature was less than 5 millimeters, the data processing unit 9*c* failed to determine the timing at which the hammers 5 passed certain points. Thus, the long inverted bell portion α is preferable for the optical fibers 25*a*.

The inverted bell portion α is connected to the straight portion β. The straight portion β has the inner diameter nearly equal to the outer diameter of the optical fiber 25*a*. The straight portion β permits the assembling worker smoothly to slide on the inner surface of the straight portion β. The straight portion β is open to the pit 32. The straight portion β is fairly long so as to force the optical fiber 25*a* to project into the pit 32 along the symmetrical line 30. Even if the optical fiber 25*a* is bent, the optical fiber 25*a* straightly projects into the pit 32. Thus, the pit 32 serves as the correcting portion γ. The pit 32 has the width greater than the inner diameter of the straight portion β, and permits the leading end of the optical fiber 25*a* to proceed to the coupling recess 31. The coupling recess 31 has a centerline aligned with the symmetrical line 30, and a tapered surface defines the coupling recess 31. This means that the cross section is gradually reduced from the entrance toward the bottom. The entrance is wider in cross section than the optical fiber, and the cross section is narrower than that of the optical fiber 25*a* at the bottom.

The leading end of the optical fiber 25*a* proceeds through the pit 32 to the coupling recess 31, and is inserted thereinto. The assembling worker further pushes the optical fiber 25*a* into the guide hole 26. Then, the leading end of the optical fiber 25*a* is snugly received in the coupling recess 31 as shown in FIG. 9. Thus, the guide hole 26 and coupling recess 31 automatically align the optical fiber 25*a* with the crossing line between the oblique surfaces, and keep the optical fiber

25*a* on the symmetrical line 30. After the coupling between the optical fiber 25*a* and the sensor head 22, the rectangular pit 32 is filled with a piece of adhesive compound so that the optical fiber 25*a* is fixed onto the symmetrical line.

When the light emitting element is energized, the light is propagated through the optical fiber 25*a*, and is radiated from the end of the optical fiber 25*a*. The light proceeds through the head portion 22*c* to the oblique surfaces, and the split light beams are reflected on the oblique surfaces toward the collimator lens 24. Since the optical fiber 25*a* is maintained on the symmetrical line 30, the amount of split light beam is equal to the amount of the other split light beam. The light is output from the collimator lenses 24 as parallel rays. The parallel rays are incident on the condenser lenses 24 of the adjacent sensor heads 22B. The incident rays are reflected on the oblique surfaces, and are fallen onto the ends of the optical fibers 25*a*. The optical fibers 25*a* propagate the light to the light detecting elements of the combined optical device 25*b*, and the light detecting elements convert the light to photo-current.

Connectors Between Sensor Heads and Supporting Plate

The sensor heads 22 are connected to the supporting plate 20 and exactly located at proper positions on the supporting plates by means of locating connectors, i.e., devices which connect the sensor heads 22 to the supporting plate 20 at the proper positions without adjusting work by an assembling worker. The locating connectors are partially formed in the sensor heads 22 and partially in the supporting plate 20.

FIGS. 10 and 11 illustrate the parts of the locating connector formed in the sensor heads 22. The parts are a pair of resiliently deformable arms 33, a locating hole 34 and a guide groove 35. The resiliently deformable arms 33 are integral with the wide portion 22*b*, and downwardly project from both sides of the wide portion 22*b*. The resiliently deformable arms 33 are formed with pawls 33*a* at the lower ends thereof, and are rounded at the boundary between the wide portion 20*b* and the narrow portion 20*a*. The pawls 33*a* inwardly project from the lower ends of the resiliently deformable arms 33. The gap between the pawls 33*a* is narrower than the gap between the resiliently deformable arms 33.

The locating hole 34 is formed in the wide portion 22*b*, and is open on the reverse surface of the sensor head 22. The locating hole 34 has a center point, which is on the symmetrical line 30. The locating hole 34 is formed at a certain point that causes the lenses 24 are opposed to the lenses of the adjacent sensor heads 22.

The guide groove 35 is formed in the narrow/wide portions 22*a*/22*b*, and has a centerline coincident with the symmetrical line 30. The guide groove 35 has a width equal to the radius of curvature of the locating hole 34, and is merged with the locating hole 34 such that the remaining portion of the locating hole 34 is more than 180 degrees. Thus, a pair of tips $\chi$ takes place at the boundary between the locating hole 34 and the guide groove 35. The tips $\chi$ are resiliently deformable so as to permit something to enter the locating hole 34. The inner surface, which defines the guide groove 35 and the locating hole 34, slopes from the reverse surface toward the ceiling.

Figure 12:
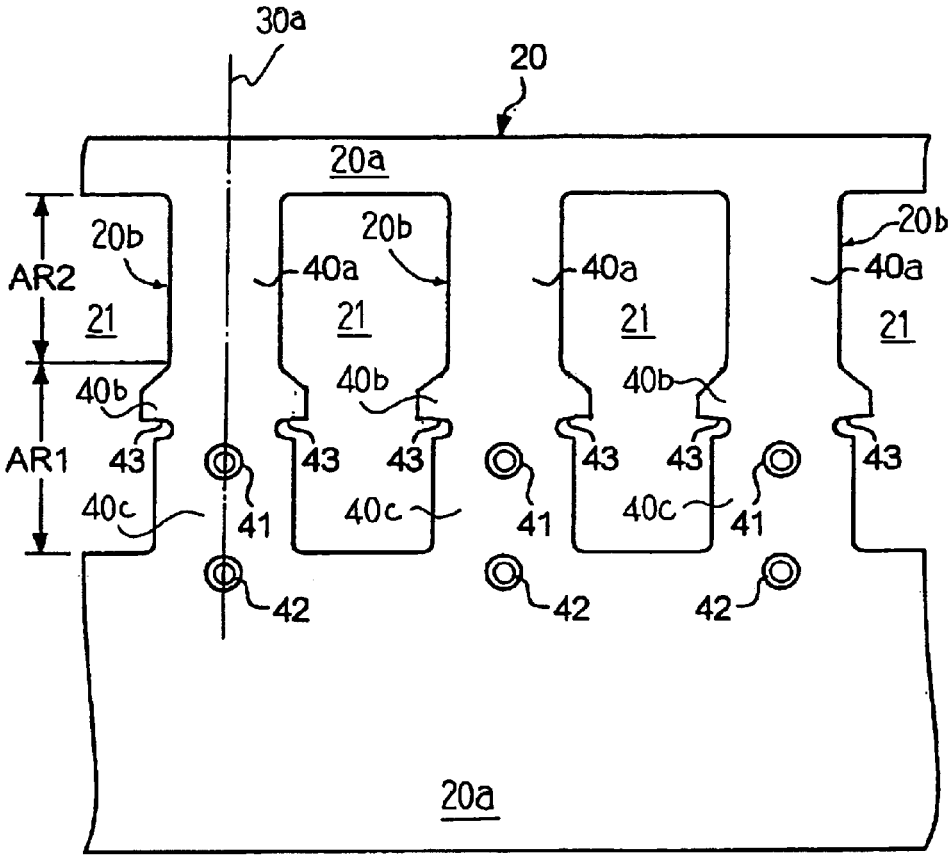
FIG. 12 is a plane view showing the configuration of a supporting plate.

FIG. 12 illustrates the supporting plate 20. The supporting plate 20 has a frame portion 20*a* and retaining portions 20*b*, and is formed with pairs of projections 41/42. The retaining portions 20*b* are spaced from one another by the slits 21, and are connected to the frame portion 20*a*. The retaining portions 20*b* are respectively assigned to the sensor heads 22. The pairs of projections 41/42 locate the sensor heads 22 at the proper positions together with the locating holes 34 and the guide grooves 35, and the sensor heads 22 are coupled to the supporting plate 20 by means of the retaining portions 20*b* and the arms/pawls 33/33*a*. The retaining portions 20*b* and the pairs of projections 41/42 serve as the parts of the locating connector formed in the supporting plate 20.

The retaining portion 20*b* has a symmetrical line 30*a*, and is divided into a coupling sub-portion AR1 and a guide sub-portion AR2. The guide subportion AR2 has a width narrower than the gap between the pawls 33*a* so that an assembling worker brings the reverse surface of the sensor heads 22 into contact with the upper surfaces 40*a* of the guide sub-portions AR2 without any interference with the pawls 33*a*. The sensor heads 22 are slidable on the upper surfaces 40*a* of the guide sub-portions AR2.

The coupling sub-portion AR1 is formed with an expander 40*b*, and has a grip 40*c*. The grip 40*c* has a width equal to the gap between the arms 33, and the expander 40*b* is gradually increased in width from the guide sub-portion 20*a* toward the grip 40*c*, and the maximum width of the expander 40*b* is greater than the width of the grip 40*c*. A pair of notches 43 is formed at the boundary between the expander 40*b* and the grip 40*c*. An assembling worker is assumed to force the sensor head 22 to slide on the upper surface 40*a* toward the coupling sub-portion AR1. The arms 33 are brought into contact with the expander 40*b*. The assembling worker exerts large force on the sensor head 22 in the sliding direction. The expander 40*b* makes the gap between the arms 33 wide, and permits the sensor head 22 to pass through the expander 40*b*. Thus, the arms 33 are resiliently deformed by the expander 40*b* so that the sensor head 22 reaches the grip 40*c*. Then, the arms 33 resiliently return to the initial positions. The grip 40*c* is pinched between the arms 33, and the pawls 33*a* press the grip 40*c* to the reverse surface of the sensor head 22. The arms 33 are formed with projections, and the projections are engaged with the notches 43. As a result, the sensor head 22 is fixed to the associated retaining portion 20*b* without any adhesive compound.

The pair of projections 41/42 is to be engaged with the locating hole 34 and the guide groove 35 so as to locate the sensor head 22 at the proper position on the supporting plate 20. The projections 41/42 have centers on the symmetrical line 30*a*. The projections 41/42 have a frusto-conical configuration. The bottom surfaces of the projections 41/42 have the diameter approximately equal to the width of the opening of the guide groove 35 and the diameter of the opening of the locating hole 34. On the other hand, the top surfaces of the projections 41/42 have the diameter approximately equal to the width of the ceiling of the guide groove 35 and the diameter of the ceiling of the locating hole 34. Thus, the projections 41/42 have a cross section corresponding to the cross section of the guide groove 35 and the cross section of the locating hole 34.

The projection 41 is formed at a certain position that makes the lenses 24 of the associated sensor head 22 opposed to the lenses 24 of the adjacent sensor heads 22 across the slits 21 when the projection 41 is snugly received in the locating hole 34. The other projection 42 is spaced from the projection 41 by a distance not longer than the distance between the center of the locating hole 34 and the entrance of the guide groove 35. Even though the projection 41 can not prohibit the sensor head 22 from rotation therearound, the projection 42 received in the guide groove 35 does not permit the sensor head 22 to rotate. Thus, the projections 41/42, locating hole 34 and guide groove 35 locate the sensor head 22 at the proper position on the supporting plate 20.

Figure 13:
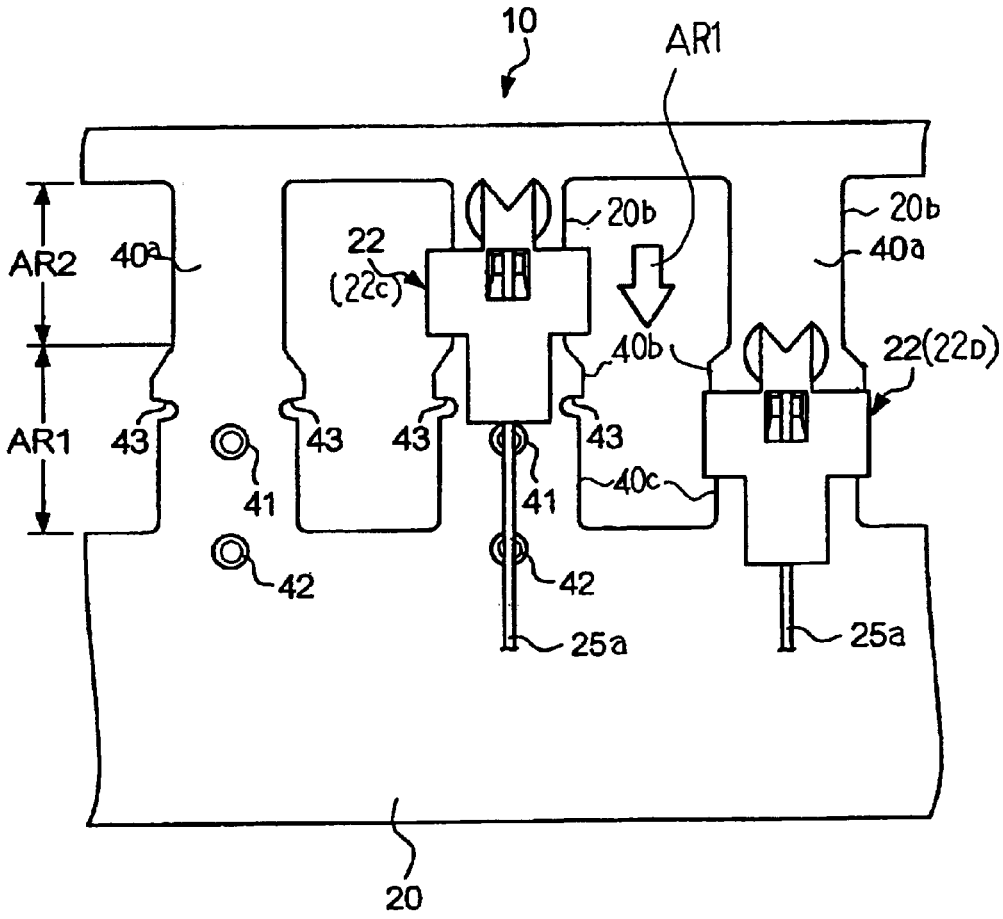
FIG. 13 is a plane view showing an assembling work on the optical sensor array.

When a worker assembles the sensor heads 22 with the supporting plate 20, the worker puts the sensor head 22C on the guide sub-portion 20*b* as shown in FIG. 13. The gap between the pawls 33*a* is wider than the width of the guide sub-portion 20*b* so that the reverse surface of the sensor head 22C is brought into contact with the upper surface 40*a* of the guide sub-portion 20*b*.

The worker slides the sensor head 22C on the upper surface 40*a* in the direction indicated by arrow AR1, and the sensor head 22C reaches the expander 40*b*. The worker presses the sensor head 22C against the expander 40*b*. Then, the arms 30 are resiliently deformed so as to increase the gap therebetween, and permit the sensor head 22C to slide on the expander 40*b*. The guide groove 35 receives the projection 41, and the sensor head 22C slides on the top surface of the projection 41. The tips $\chi$ are brought into contact with the projection 41, and the other projection 42 reaches the entrance of the guide groove 35. The worker feels the tips $\chi$ resistive against the sliding motion. The worker increases the force exerted on the sensor head 22. Then, the tips $\chi$ are resiliently deformed so that the projection 41 enters the locating hole 34. Concurrently, the arms 33 are disengaged from the expander 40*b*, and pinch the grip 40*c* therebetween. The pawls 33*a* press the grip 40*c* against the reverse surface of the sensor head 22D. The locating hole 34 does not permit the worker to slide the sensor head 22D in the direction indicated by the arrow AR1, and the other projection 42 does not allow the sensor head 22D to rotate around the projection 41. Thus, the sensor head 22D is located at the proper position where the lenses 24 are opposed to the lenses 24 of the adjacent sensor heads 22 across the trajectories of the sectorial plates 13.

As will be understood from the foregoing description, the locating connectors according to the present invention makes the assembling worker fix the sensor heads 22 to the supporting plate 20 at the proper positions without any adhesive compound. The lenses 24 are never contaminated with adhesive compound, and the assembling work is simpler than that for the prior art sensor heads. This results in enhancement of productivity of the optical sensor array 10. The sensor heads 22 are less liable to be broken in the assembling work, because the assembling worker only exerts the small force on the sensor heads 22 for increasing the gap between the arms 33. Even if the sensor head 22 is broken in the assembling work, the worker is required for laterally expanding the arms 33 with a suitable tool. Then, the sensor head 22 can pass the expander 40*b*, and reaches the guide sub-portion 20*b*, again. Thus, the locating connector according to the present invention enhances the productivity and repairability of the optical sensor array 10. Using the optical sensor array 10 according to the present invention, the manufacturer reduces the production cost of the silent piano.

In the above-described embodiment, the black/white key 8*a*/8*b*, action unit 4 and hammer 5 as a whole constitute a tone specifying mechanism, and plural tone specifying mechanisms are incorporated in the silent piano, and the data processing unit 9*c* and headphone 9*d* form in combination a tone generating unit. The arms 33, pawls 33*a*, expander 40*b* and grip 40*c* serves as a coupler between the sensor head 22 and the supporting plate 20, and the guide groove 35, locating hole 34 and projections 41/42 serve as a locator. The coupler and locator as a whole constitute the locating connector. Although the locating connector is imaginary divided into the locator and coupler, the coupler is linked with the locator, and each of the sensor heads 22 is connected to and located at the proper positions on the supporting plate 20 through a continuous motion of the sensor head 22. In this instance, the coupler and locator are arranged in symmetry with respect to the centerlines 30/30*a*. The assembling worker is expected to roughly align the centerline 30 with the centerline 30*a* and, thereafter, slide the sensor head 22 on the upper surface 40*a*. Thus, the locating connector according to the present invention makes the assembling work easy. The sectorial plates 13 formed with the gray scales serve as plural light modifiers.

Control Sequence on Combined Photo Device

Figure 14:
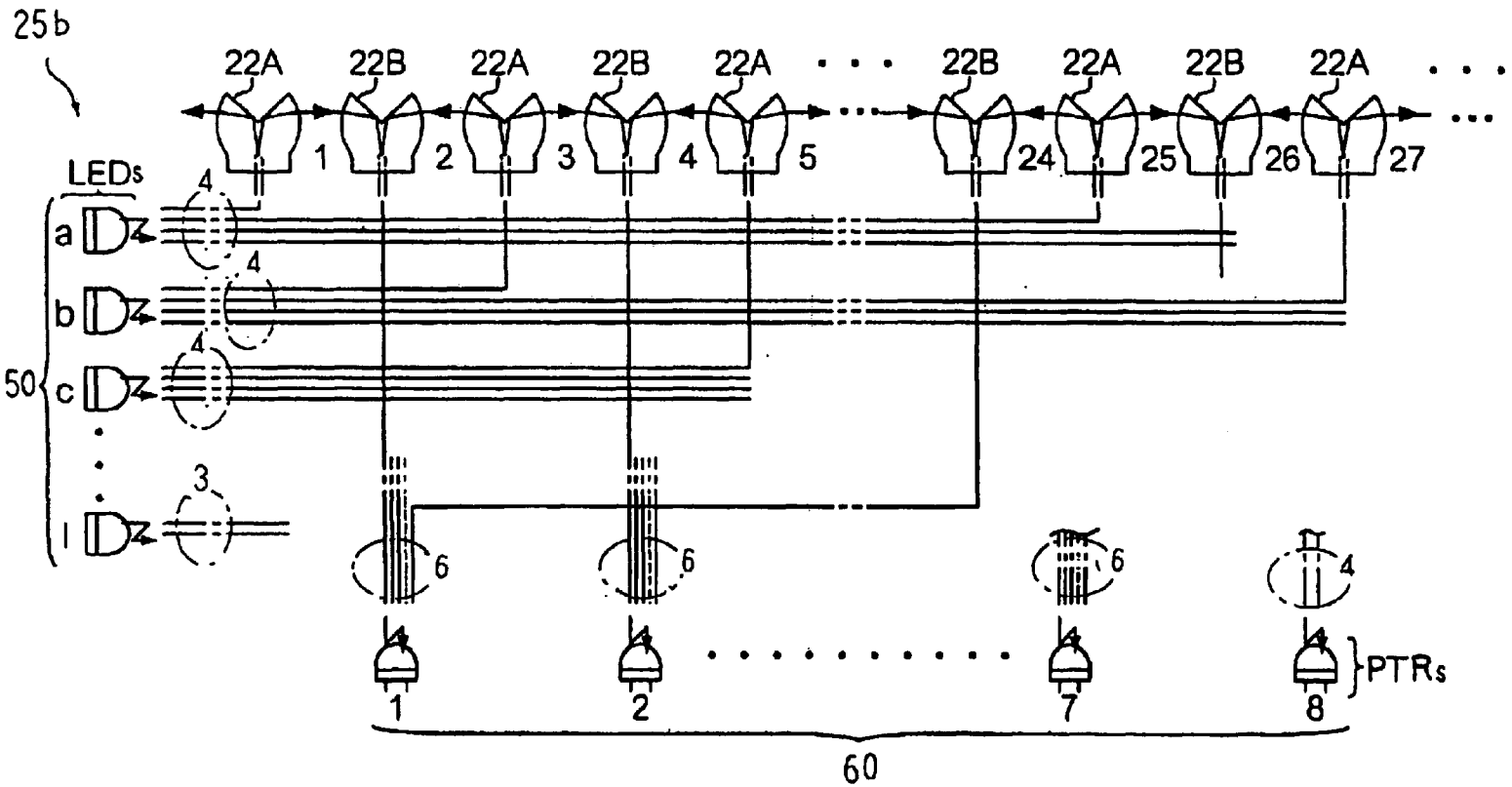
FIG. 14 is a diagram showing the connections between the sensor heads and a combined optical device.

The optical sensor array 10 according to the present invention is controlled as follows. The moving objects, i.e., the black/white keys 8*a*/8*b* are eighty-eight, and, accordingly, eighty-eight hammers 5 are incorporated in the silent piano. This means that the optical sensor array 10 is expected individually to monitor the eighty-eight moving objects 5. For this reason, eighty-nine sensor heads 22 are arranged on the supporting plate 20. The forty-five sensor heads 22A are altered with the forty-four sensor heads 22B, and each hammer 5 is assigned to the gap between the sensor head 22A and the associated sensor head 22B as shown in FIG. 14. The eighty-nine sensor heads 22 are respectively labeled with numerals "1", "2", . . . , "5", . . . "24", "25", "26", "27", . . . so that each sensor head is individualized with the numeral.

Figure 15:
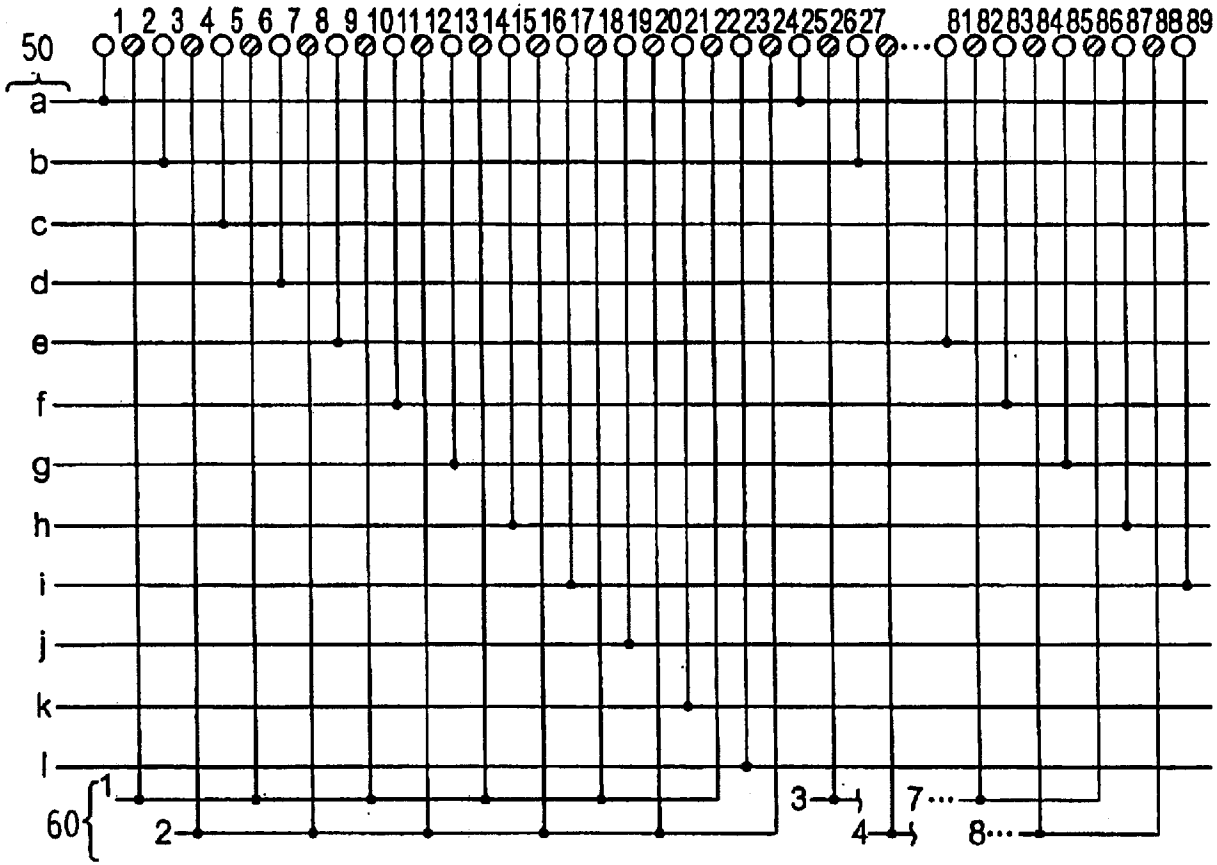
FIG. 15 is a diagram showing the relation between black/white keys and the sensor heads in the silent piano.

The combined optical device includes twelve light emitting elements such as, for example, light-emitting diodes, i.e., LEDs 50, eight light detecting elements such as, for example, photo-transistors, i.e., PTRs 60, a driver circuit (not shown) for selectively energizing the twelve light-emitting diodes 50 and a current-to-voltage converter (not shown) for producing the hammer position signals from photo-current. The light emitting diodes 50 are respectively labeled with "a", "b2", "c" . . . and "1", and the photo-transistors 60 are individualized with numerals "1", "2", . . . , "7" and "8". The twelve light-emitting diodes 50 are selectively connected to the sensor heads 22A through the optical fibers 25*a*. In this instance, each of the light-emitting diodes "a" to "m" are connected to four sensor heads 22A, and the remaining light-emitting diode "1" is connected to three sensor heads 22A. The four or three sensor heads 22A associated with each light-emitting diode 50 are respectively assigned to the hammers 5 spaced at intervals of 2 octaves. The sensor heads 22B are selectively connected to the eight photo-transistors 60 through the optical fibers 25*a*. Each of the first to seventh photo-transistors "1" to "7" is connected to six sensor heads 22B, and the eighth photo-transistor "8" is connected to four sensor heads 22B. The six or four sensor heads connected to each photo-transistor 60 are spaced at intervals of four. For example, the photo-transistor "1" is connected to the sensor heads "2", "6", "10", "14", "18" and "22" (see FIG. 15).

The light-emitting diodes 50 and photo-transistors 60 are assigned to the sensor heads 22A and 22B in such a manner that each of the sensor heads 22B receives the light from only one sensor head 22A on either side thereof. This means that the sensor heads 22A on both sides of each sensor head 22B do not concurrently radiate the light to the sensor head 22B. The twelve light-emitting diodes 50 are respectively assigned to time slots, and twelve time slots form a single scanning cycle.

The data processing unit 9*c* periodically instructs the driver circuit sequentially to energize the twelve light-emitting diodes 50 in the respective time slots. The light is propagated through the associated optical fibers 25*a* to the sensor heads 22A, and the four or three sensor heads 22A concurrently radiate the light beams to the adjacent sensor heads 22B. The light beams are incident on the adjacent eight or six sensor heads 22B, and the incident light is propagated through the optical fibers 25*a* to the photo-transistors. The photo-transistors 60 converts the light to photo-current, and the amount of photo-current is proportional to the amount of incident light. The photo-transistors 60 are respectively connected to the current-to-voltage converters so that the hammer position signals are produced from the photo-current.

The driver circuit is assumed to energize the light-emitting diode "a" in a certain time slot, and the light-emitting diode "a" radiates the light. The light is distributed to the sensor heads "1", "25", "49" and "73". The light beams are radiated from the sensor head "1" to the sensor head "2", from the sensor head "25" to the sensor heads "24" and "26", from the sensor head "49" to the sensor heads "48" and "50" and from the sensor head "73" to the sensor heads "72" and "74". The sectorial plates 13 are provided on the seven optical paths so that the light beams are individually modulated by the gray scales on the sectorial plates 13 The sensor heads "2", "24", "26", "48", "50", "72" and "74" are respectively connected through the optical fibers 25*a* to the photo-transistors "1" to "7" so that the combined optical device 25*b* concurrently supplies the seven hammer position signals to the data processing unit 9*c*. The data processing unit 9*c* discriminates the seven hammer positions from the other hammer positions, because only seven light beams are valid in the tile slot.

Subsequently, the driver circuit energizes the light-emitting diode "b" in the next time slot. The light-emitting diode "b" radiates the light. The light is distributed to the sensor heads "3", "27", "51" and "75". The light beams are radiated from the sensor head "3" to the sensor heads "2" and "4", from the sensor head "27" to the sensor heads "26" and "28", from the sensor head "51" to the sensor heads "50" and "52" and from the sensor head "75" to the sensor heads "74" and "76". The sectorial plates 13 are provided on the eight optical paths so that the light beams are individually modulated by the gray scales on the sectorial plates 13. The sensor heads "2", "4", "26", "28" "40", "52", "72", "74" and "76" are respectively connected through the optical fibers 25*a* to the photo-transistors "1" to "8" so that the combined optical device 25*b* concurrently supplies the eight hammer position signals to the data processing unit 9*c*. Although the sensor heads such as "2" and "26" received the light in the previous tile slot, the data processing unit 9*c* discriminates the hammers 5 represented by the hammer position signals at the sensor heads "2", "26", . . . from the hammers 5 represented by the hammer position signals at the same sensor heads "2", "26", . . . on the basis of the time slots. The data processing unit 9*c* compares the value of each hammer position signals with plural thresholds so as to determine the current hammer position. The data processing unit 9*c* accumulates the variation of the hammer position in the memory, and calculates the hammer velocity on the basis of the lapse of time between the plural thresholds. Otherwise, the data processing unit 9*c* determines the hammer velocity on the basis of the gradient of the variation of the photo-current.

As will be appreciated from the foregoing description, the locating connector according to the present invention permits an assembling worker to exactly locate the sensor heads 22 at and connect it to the proper positions on the supporting plate 20 through the continuous sliding motion. Any adhesive compound is not required for the connection between the sensor heads 22 and the supporting plate 20. Thus, the locating connector enhances the productivity and repairability of the optical sensor array, and the manufacturer can reduce the production cost of the keyboard musical instrument.

Although the particular embodiment of the present invention has been shown and described, it will be apparent to those skilled in the art that various changes and modifications may be made without departing from the spirit and scope of the present invention.

Figure 16:
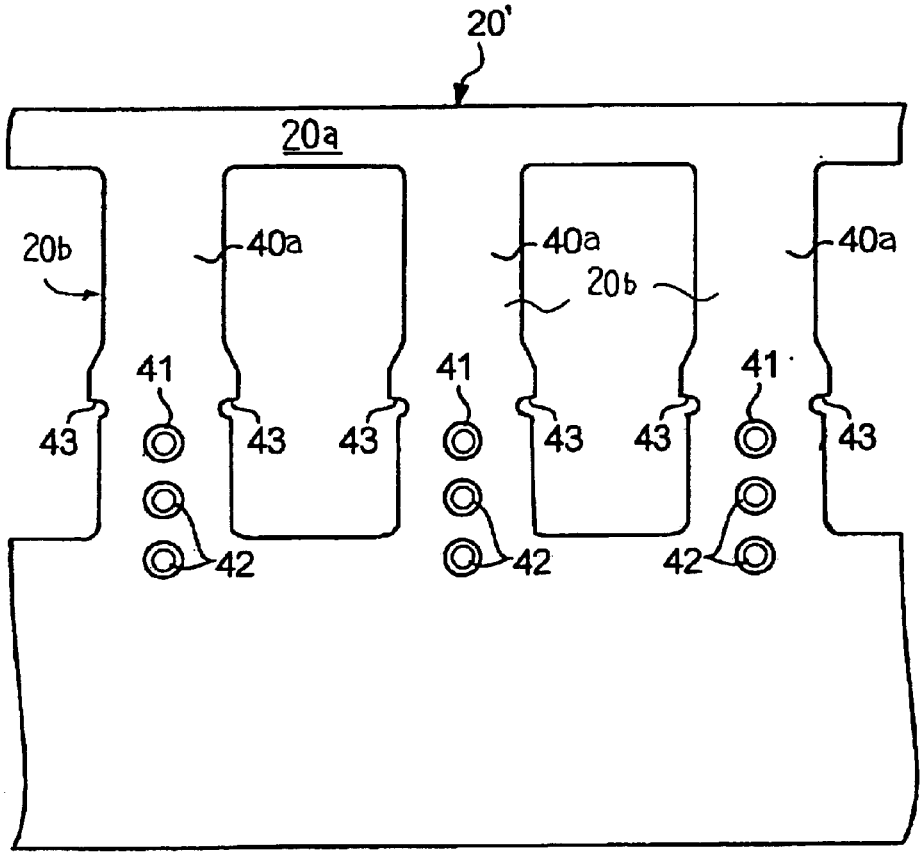
FIG. 16 is a plane view showing the first modification of the supporting plate.

More than one projection 42 may be formed on the supporting plate 20' as shown in FIG. 16. In this instance, when the projection 41 is received in the locating hole 34, all the projections 42 are engaged with the guide groove 35, and prevent the sensor head 22 from the rotation about the projection 41.

Figure 17:
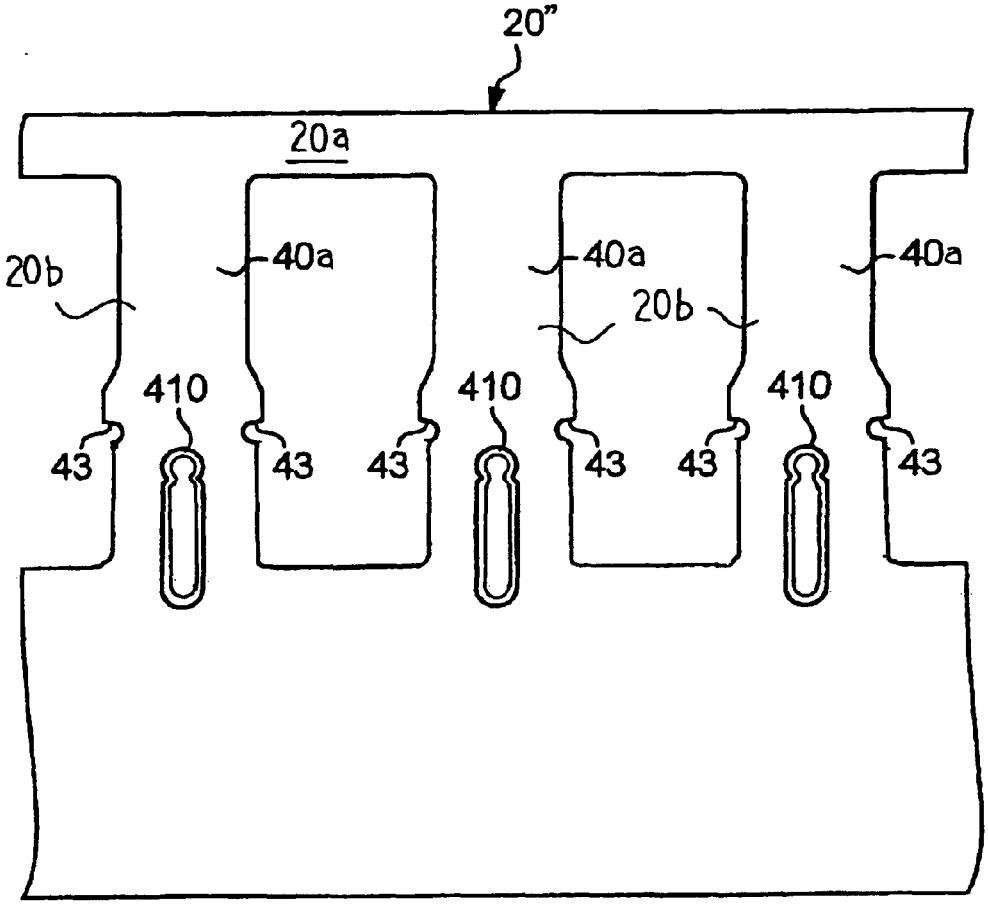
FIG. 17 is a plane view showing the second modification of the supporting plate.

The projections 41 and 42 may be integrated into land portions 410 as shown in FIG. 17. The land portion is constricted so that the tips $\chi$ are engaged with the constricted portion. While the assembling worker slides the sensor head 22 on the upper surface 40*a*, the land portion 410 is moved into the guide groove 35. The land portion 410 passes over the tips $\chi$. The tips $\chi$ are resiliently deformed so as to permit the leading end portion is snugly received in the locating hole 34.

Figure 18:
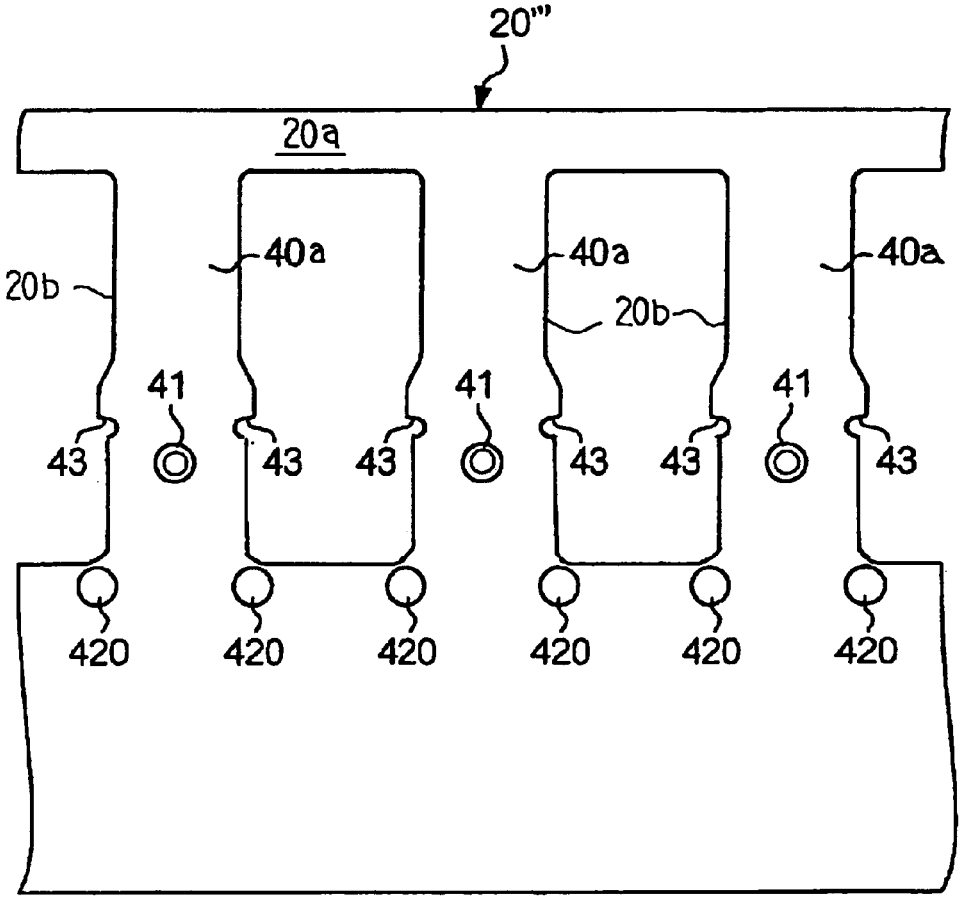
FIG. 18 is a plane view showing the third modification of the supporting plate.

The projections 42 may be replaced with pairs of projections 420 as shown in FIG. 18. The projections 420 of each pair are located on both sides of the sensor head 22. When the projection 41 is snugly received in the locating hole 34, the sensor head 22 is sandwiched between the projections 42. Thus, the projections 420 prohibit the sensor head 22 from the rotation about the projection 41.

Figure 19:
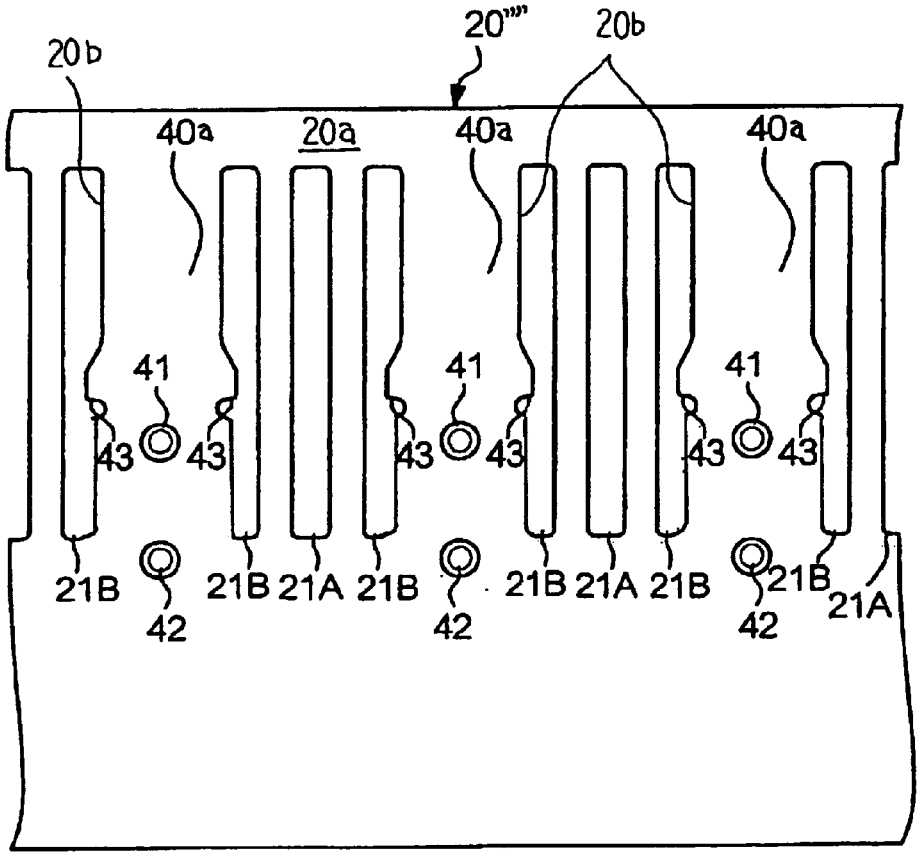
FIG. 19 is a plane view showing the fourth modification of the supporting plate.

Each of the slits 21 may be divided into three narrow slits 21A and 21B as shown in FIG. 19. The center slit 21A is assigned to the sectorial plate 13, and the narrow slits 21B on both sides of the slit 21A are assigned to the resiliently deformable arms 33. This feature is desirable, because the inner space is kept dark. When a worker assembles the sensor head 22 with the supporting plate 20"", the worker firstly inserts the resiliently deformable arms 33 into the narrow slits 21B, and brings the reverse surface of the sensor head 22 into contact with the upper surface 40*a*. Subsequently, the worker slides the sensor head 22 on the upper surface 40*a*. Then, the expander 40*b* widens the gap between the resiliently deformable arms 33 so that the sensor heads 22 reaches the coupler 40*c*. The projection 41 is snugly received in the locating hole 34, and the other projection 42 is engaged with the guide groove 35 as similar to the above-described embodiment.

Figure 1:
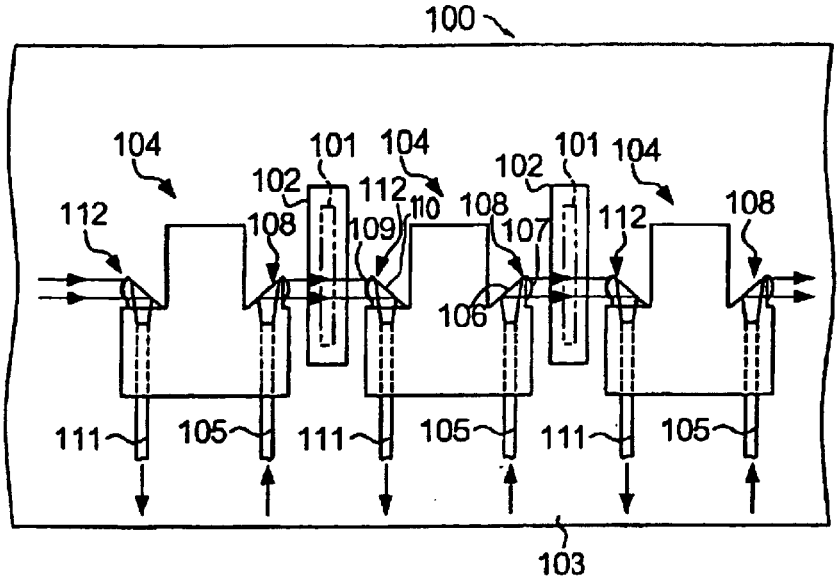
Fig. 1 PRIOR ART
FIG. 1 is a bottom view showing the arrangement of the prior art optical sensor array.
Figure 2:
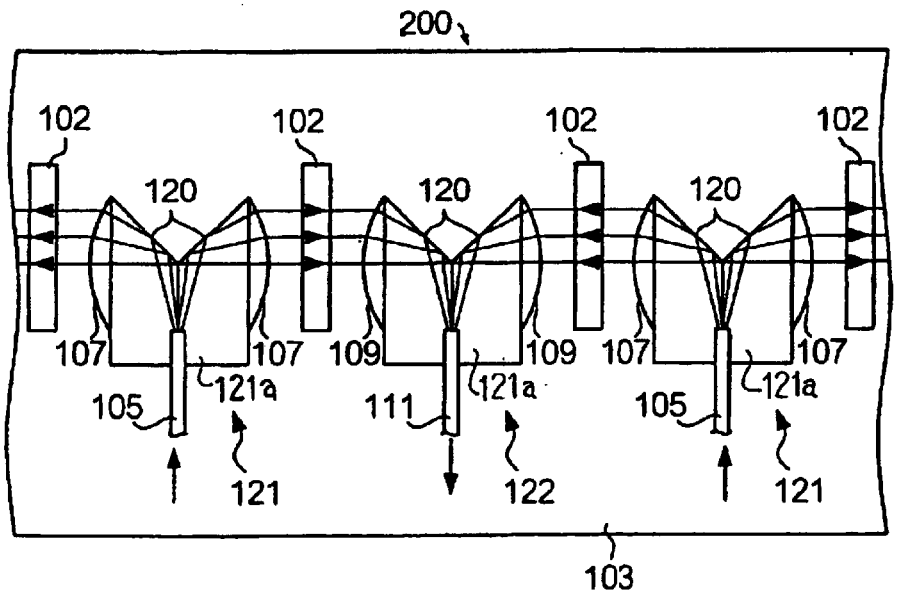
Fig. 2 PRIOR ART
FIG. 2 is a bottom view showing the arrangement of another prior art optical sensor array.
Figure 20:
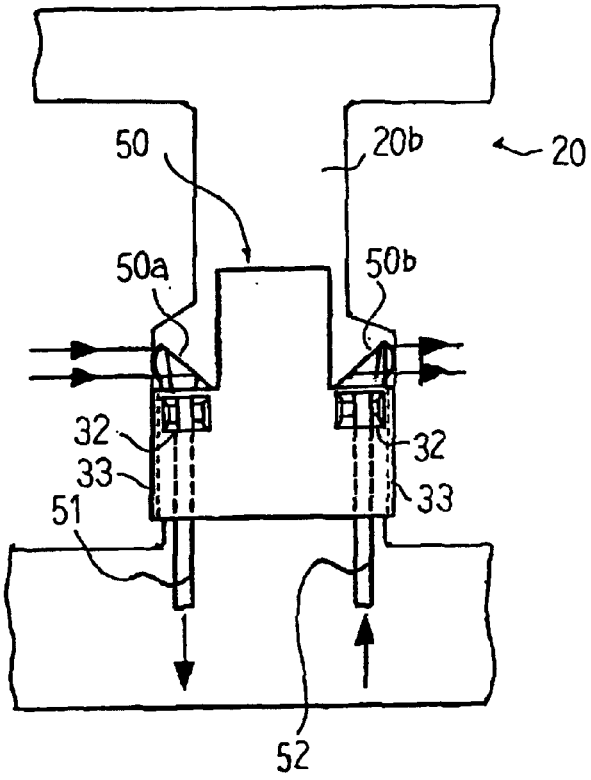
FIG. 20 is a plane view showing a modification of the sensor head.
Figure 21:
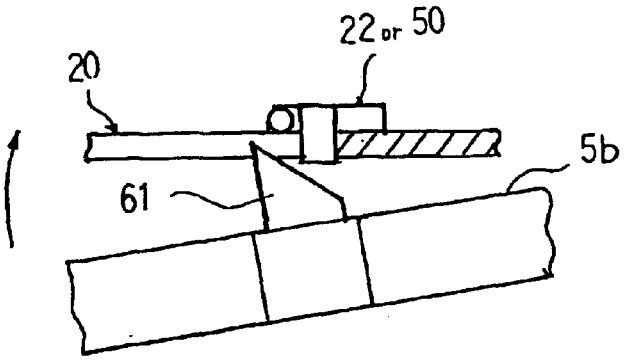
FIG. 21 is a side view showing a shutter plate with which the sectorial plate is replaced.

The present invention may be applied to the sensor head shown in FIG. 1. FIG. 20 shows a sensor head 50 according to the present invention. The sensor head 50 has a light inlet port 50*a* and a light outlet port 50*b*, and two optical fibers 51 and 52 are inserted into the sensor head 50. A pair of pits 32 is formed in the sensor head 50, and the optical fibers 51/52 are terminated at the receiving holes exposed to the pits 32. Adhesive compound are solidified in the pits 32 so as to fix the optical fibers 51/52 to the sensor head 50. A pair of resiliently deformable arms 33 downwardly project from both sides of the sensor head 50, and have the pawls 33*a* as similar to the sensor head 22. The sensor heads 50 are arranged on the supporting plate 20, and are connected to and located at proper positions on the supporting plate 20 by means of the locating connectors of the sensor heads 50.

A shutter plate 61 may be attached to the hammer shank 5*b*. In other words, the sectorial plate 13 with the gray code is replaceable with the shutter plate 61. The shutter plate 61 gradually intersects the light beam so that the hammer position is converted to the amount of light incident on the light inlet port of the sensor head 22/50. The shutter plates 61 serves as plural light modifiers.

The optical sensor array according to the present invention may be incorporated in another sort of keyboard musical instrument. An automatic player piano is another sort of composite keyboard musical instrument. The automatic player piano is a combination of an acoustic piano and an automatic playing system. The acoustic piano is either grand or upright. The automatic playing system includes solenoid-operated key actuators installed under the keyboard and a controller. When a set of music data codes is supplied to the controller, the controller analyzes the set of music data codes. The controller specifies the keys to be moved, and determines times at which the keys start the motion. When the time comes, the controller supplies a driving signal to the solenoid-operated key actuator under the key to be moved. The solenoid-operated key actuator moves the key at the predetermined time, and the key actuates the action unit so as to give rise to free rotation of the hammer toward the string. The automatic player piano may further have the hammer stopper.

The keyboard for practical use is yet another sort of the composite keyboard musical instrument. The hammer assemblies and strings are replaced with beaters and an impact absorber. While a trainee is fingering a piece of music on the keyboard, the depressed keys actuate the associated action units, which in turn give rise to free rotation of the hammers through the escape. The beaters rebound on the impact absorber, and the piano tones are not generated. The electronic tone generating system is incorporated in the keyboard for practical use. In this instance, the optical sensor array monitors the beaters, and periodically report the current positions of the beaters to the data processing unit. The data processing unit analyzes the series of positional data information, and produces the music data codes. The music data codes are supplied to the tone generator so as to generate the electronic tones. Thus, the trainee checks the electronic tones for his or her fingering.

A keyboard musical instrument may have keys greater than or less than 88.

The projections 42 may be formed in a frustum of pyramid or another configuration.

In the above-described embodiment and modifications, the locating hole 34 and guide groove 35 are formed in the sensor head, and the projections 41/42 are formed on the supporting plate 20. However, they are exchangeable. The locating hole and guide groove may be formed in the supporting plate, and the projections 41/42 or land portion 410 may be formed on the reverse surface of the sensor head.

The optical sensor array 10 according to the present invention may be used for monitoring plural moving objects such as, for example, pistons, links, keys of another use and so forth.

What is claimed is:

1. An optical sensor array for converting current positions of moving objects to signals, comprising:

a supporting plate having plural retaining portions at intervals;

plural sensor heads respectively assigned to said plural retaining portions, and establishing optical paths for light beams across said intervals;

a combined optical device optically connected to said plural sensor heads, and selectively supplying light to and receiving said light from said plural sensor heads through said optical paths;

plural light modifiers connected to said moving objects, and moved in said optical paths for modifying said light beams depending upon the current positions of the associated moving objects; and plural locating connectors formed partially in said plural sensor heads and partially in said plural retaining portions, and connecting said plural sensor heads to target positions on said retaining portions through sliding motion of said sensor heads on the associated retaining portions.

2. The optical sensor array as set forth in claim 1, in which said supporting plate is formed with plural slits in said intervals so that said light beams extend across said slits, and said plural light modifiers pass through the associated slits for intersecting said light beams.

3. The optical sensor array as set forth in claim 2, in which said plural light modifiers are formed by plates where a gray code is formed for modifying the amount of light beams.

4. The optical sensor array as set forth in claim 2, in which said plural light modifiers are formed by shutter plates for modifying the amount of light means.

5. The optical sensor array as set forth in claim 2, in which said plural slits define said retaining portions in said supporting plate in such a manner that each of said retaining portions has a guide portion where an associated one of said sensor heads slides, a part of a coupler contiguous to said guide portion and a part of a locator, and each of said sensor heads is formed with another part of said coupler fixed to said part of said coupler for fixing the sensor head to the associated one of said retaining portions and another part of said locator engaged with said part of said locator for keeping said sensor head at the target position.

6. The optical sensor array as set forth in claim 5, in which said part of said coupler includes an expander gradually increased from a first width equal to that of said guide portion to a second width and a grip portion having a third width wider than said first width and narrower than said second width, and said another part of said coupler includes resiliently deformable arms spaced from each other by a distance not wider than said third width so that said grip portion is pinched between said resiliently deformable arms at the end of said sliding motion from said guide portion through said expander to said grip portion.

7. The optical sensor array as set forth in claim 6, in which said resiliently deformable arms project from both side portions of said each of said plural sensor heads, and said another part of said coupler further includes pawls inwardly projecting from leading ends of said resiliently deformable arms so that said grip portion is further sandwiched between said pawls and a surface of said each of said plural sensor heads.

8. The optical sensor array as set forth in claim 6, in which said pawls and said resiliently deformable arms are integral with said each of said plural sensor heads.

9. The optical sensor array as set forth in claim 6, in which said resiliently deformable arms are moved in two of said slits on both sides of said each of said retaining portions during said sliding motion of said each of said plural sensor heads from said guide portion through said expander to said grip portion.

10. The optical sensor array as set forth in claim 9, in which each of said slits is divided into three sub-slits, and associated one of said plural light modifiers and said resiliently deformable arms are assigned to one of said three sub-slits at the center position and remaining two sub-slits on both sides of said one of said three sub-slits.

11. The optical sensor array as set forth in claim 5, in which said part of said locator includes a first projection formed on said each of said plural retaining portions and a second projection formed on said each of said plural retaining portions, as wide as said first projection and spaced from said first projection in the direction of said sliding motion, and said another part of said locator includes a guide groove as wide as said first and second projections, open at an end surface of said associated one of said plural sensor heads and extending in said direction of said sliding motion and a locating hole as wide as said first projection and merged with said guide groove at the other end opposite to the end open at said end surface so that said first projection and said second projection are received in said locating hole and said guide groove when said each of said plural sensor heads reaches said target position.

12. The optical sensor array as set forth in claim 11, in which said each of said retaining portions and said each of said plural sensor heads have a first centerline extending in said direction of said sliding motion and a second centerline, respectively, and said first and second projections and both of said guide groove and said locating hole are formed on said first centerline and said second centerline, respectively.

13. The optical sensor array as set forth in claim 11, in which said another part of said locator further includes at least one third projection spaced from said second projection in said direction of said sliding motion and received in said guide groove together with said second projection when said each of said plural sensor heads reaches said target position.

14. The optical sensor head as set forth in claim 11, in which said first projection is merged with said second projection so as to form a land portion as wide as said guide groove and said locating hole and extending in said direction of said sliding motion.

15. The optical sensor array as set forth in claim 5, in which said part of said locator includes a first projection formed on said each of said plural retaining portions and at least two second projections formed on said each of said plural retaining portions and spaced from each other in a direction perpendicular to the direction of said sliding motion by a distance equal to a width of said each of said plural sensor heads, and said another part of said locator includes a guide groove as wide as said first projection, open at an end surface of said associated one of said plural sensor heads and extending in said direction of said sliding motion and a locating hole as wide as said first projection and merged with said guide groove at the other end opposite to the end open at said end surface so that said at least two second projections prevent said each of said plural sensor heads about said first projection received in said locating hole when said each of said plural sensor heads reaches said target position.

16. A keyboard musical instrument for generating audible tones from an electric signal, comprising:

plural tone specifying mechanisms selectively actuated by a player for specifying tones to be generated;

a tone generating unit generating the tones specified by said player through said plural tone specifying mechanisms; and an optical sensor array monitoring said plural tone specifying mechanisms so as to determine the tone specifying mechanisms actuated by said player, and including a supporting plate having plural retaining portions at intervals, plural sensor heads respectively assigned to said plural retaining portions and establishing optical paths for light beams across said intervals, a combined optical device optically connected to said plural sensor heads and selectively to supplying light to and receiving said light from said plural sensor heads through said optical paths, plural light modifiers connected to said plural tone specifying mechanisms, and moved in said optical paths for modifying said light beams depending upon the current positions of the associated tone specifying mechanisms, and plural locating connectors formed partially in said plural sensor heads and partially in said plural retaining portions and connecting said plural sensor heads to target positions on said retaining portions through sliding motion of said sensor heads on the associated retaining portions.

17. The keyboard musical instrument as set forth in claim 16, in which said supporting plate is formed with plural slits in said intervals so that said light beams extend across said slits, and said plural light modifiers pass through the associated slits for intersecting said light beams.

18. The keyboard musical instrument as set forth in claim 17, in which said plural slits define said retaining portions in said supporting plate in such a manner that each of said retaining portions has a guide portion where an associated one of said sensor heads slides, a part of a coupler contiguous to said guide portion and a part of a locator, and each of said sensor heads is formed with another part of said coupler fixed to said part of said coupler for fixing the sensor head to the associated one of said retaining portions and another part of said locator engaged with said part of said locator for keeping said sensor head at the target position.

19. The keyboard musical instrument as set forth in claim 18, in which said part of said coupler includes an expander gradually increased from a first width equal to that of said guide portion to a second width and a grip portion having a third width wider than said first width and narrower than said second width, and said another part of said coupler includes resiliently deformable arms spaced from each other by a distance not wider than said third width so that said grip portion is pinched between said resiliently deformable arms at the end of said sliding motion from said guide portion through said expander to said grip portion.

20. The keyboard musical instrument as set forth in claim 19, in which said resiliently deformable arms project from both side portions of said each of said plural sensor heads, and said another part of said coupler further includes pawls inwardly projecting from leading ends of said resiliently deformable arms so that said grip portion is further sandwiched between said pawls and a surface of said each of said plural sensor heads.

21. The keyboard musical instrument as set forth in claim 20, further comprising plural vibratory strings associated with said plural tone specifying mechanisms and selectively struck with hammers of said plural tone specifying mechanisms for generating acoustic tones.

22. The keyboard musical instrument as set forth in claim 21, in which said hammers are monitored by said optical sensor array so that said plural light modifiers are connected to said hammers, respectively.

23. The keyboard musical instrument as set forth in claim 21, further comprising a hammer stopper changed between a blocking position provided on trajectories of said hammers and a free position provided out of said trajectories, and said hammers rebound on said hammer stopper at said blocking position before striking said strings.

24. The keyboard musical instrument as set forth in claim 23, in which said hammers are monitored by said optical sensor array so that said plural light modifiers are connected to said hammers, respectively.

* * * * *